US011820573B2

(12) United States Patent
Steinkamp et al.

(10) Patent No.: US 11,820,573 B2
(45) Date of Patent: Nov. 21, 2023

(54) TAMPER-EVIDENT PACKAGE, IN PARTICULAR CHILD-PROOF PACKAGE

(71) Applicant: Focke & Co. (GmbH & Co. KG), Verden (DE)

(72) Inventors: Irmin Steinkamp, Hemslingen (DE); Henry Buse, Visselhövede (DE); Gisbert Engel, Kirchlinteln-Luttum (DE); Viktor Hein, Kirchlinteln-Luttum (DE)

(73) Assignee: Focke & Co. (GmbH & Co. KG), Verden (DE)

( * ) Notice: Subject to any disclaimer, the term of this patent is extended or adjusted under 35 U.S.C. 154(b) by 0 days.

(21) Appl. No.: 17/782,248

(22) PCT Filed: Dec. 2, 2020

(86) PCT No.: PCT/EP2020/084337
§ 371 (c)(1),
(2) Date: Jun. 3, 2022

(87) PCT Pub. No.: WO2021/110781
PCT Pub. Date: Jun. 10, 2021

(65) Prior Publication Data

US 2023/0009428 A1 Jan. 12, 2023

(30) Foreign Application Priority Data

Dec. 6, 2019 (DE) ..... 102019133300.8

(51) Int. Cl.
*B65D 77/04* (2006.01)
*B65D 5/38* (2006.01)
*B65D 85/10* (2006.01)

(52) U.S. Cl.
CPC ..... *B65D 77/042* (2013.01); *B65D 5/38* (2013.01); *B65D 85/1054* (2013.01); *B65D 85/1081* (2013.01); *B65D 2215/02* (2013.01)

(58) Field of Classification Search
CPC ..... B65D 5/38; B65D 77/04; B65D 77/042; B65D 85/10; B65D 85/1054; B65D 85/1081; B65D 2215/02
(Continued)

(56) References Cited

U.S. PATENT DOCUMENTS 5,732,822 A 3/1998 Mitsuyama
6,491,211 B1 12/2002 Evans

FOREIGN PATENT DOCUMENTS

DE 112016000845 T5 10/2017
WO 2008054305 A1 5/2008
WO 2015000896 A1 1/2015

OTHER PUBLICATIONS

WIPO, International Search Report (in a related application), dated Mar. 18, 2021.

(Continued)

*Primary Examiner* — Bryon P Gehman
(74) *Attorney, Agent, or Firm* — Laurence P. Colton; SMITH TEMPEL BLAHA LLC

(57) ABSTRACT

A tamper-evident, child-proof package, having an outer package and having an inner package, the inner package being at least partially received in the outer package, and the inner package for opening and closing the package being disposed so as to be displaceable in the outer package, and the package has at least one securing structure as an anti-tamper feature for impeding or preventing the opening of the package, or the access to the products disposed in the inner package. The at least one securing structure is effective between the inner package and the outer package so as to (Continued)

impede or prevent the inner package being displaced in the outer package in order for the package to be opened.

16 Claims, 14 Drawing Sheets

(58) Field of Classification Search
USPC ..... 206/1.5
See application file for complete search history.

(56) References Cited

OTHER PUBLICATIONS

Deutsches Patent-und Markenamt (German Patent and Trademark Office), Rechercherbericht (search in a related application), Sep. 8, 2020.

XII
XII

TAMPER-EVIDENT PACKAGE, IN PARTICULAR CHILD-PROOF PACKAGE

CROSS-REFERENCE TO RELATED APPLICATIONS

This application is the US national phase of and claims the benefit of and priority on International Application No. PCT/EP2020/084337 having an international filing date of 2 Dec. 2020, which claims priority on and the benefit of German Patent Application No. 10 2019 133 300.8 having a filing date of 6 Dec. 2019.

BACKGROUND OF THE INVENTION

Technical Field

The invention relates to a tamper-evident package, in particular child-proof package, having an outer package and having an inner package, wherein the inner package is at least partially received in the outer package, and wherein the inner package for opening and closing the package is disposed so as to be displaceable in the outer package, and wherein the package as an anti-tamper feature has at least one securing means for impeding or preventing the opening of the package, or the access to the products disposed in the inner package.

Prior Art

Child-proof packages are intended to prevent contact between infants or children, who are not yet able to overcome a complex opening mechanism, and the potentially harmful content. The use of many products which pose a health hazard for infants is mandatorily prescribed by national and international legislation. The present invention relates to securing mechanisms of this type, or similar securing mechanisms, which hereunder are generally referred to as an anti-tamper feature and thus do not relate only or exclusively to infants or children.

One intended use of anti-tamper features can be in the sector of packages for alternative tobacco products or *cannabis* products, for example. The global consumption of alternative tobacco products (e-cigarettes) and that of *cannabis* products already legal in many countries is steadily increasing. The future prospects point to a market that will very rapidly increase in the future. It is also to be expected here that many parents store and consume their *cannabis* products at home, for example for treating a raft of health issues. As a result, there is the risk of their children discovering the corresponding stock and thus accessing the hazardous substances. In children, this can lead to detrimental health conditions or serious consequences, even when very small quantities are taken. In order for access to the substances to be impeded for children, guidelines and directives which prescribe or regulate the marketing of the *cannabis* products in child-proof packaging, and that this packaging has to be certified according to published directives and guidelines, have been published by national legislative bodies.

In order to meet the consumer demand expected in the future, the tobacco and *cannabis* corporations have to respond with child-proof and cost-effective packaging products that are suitable for mass production and potentially may also contain other types of packaging such as child-proof blister packs, flow packs, four-sided sealed pouches, or the like. Of course, this also applies to corporations from other sectors of the economy.

Various known variants of child-proof packages indeed exist which impede access to the products and require two hands for operating. However, packages of this type are typically of a complex construction and, therefore, difficult to produce on conventional packaging machines.

BRIEF SUMMARY OF THE INVENTION

Proceeding therefrom, the invention is based on the object of refining packages of the type mentioned at the outset, in particular with a view to a construction that meets the requirements set for child-proof packages but on the other hand permits the packages to be produced in a cost-effective manner on preferably largely conventional packaging machines.

A package for achieving this object is a tamper-evident package, in particular child-proof package, having an outer package and having an inner package, wherein the inner package is at least partially received in the outer package, and wherein the inner package for opening and closing the package is disposed so as to be displaceable in the outer package, and wherein the package as an anti-tamper feature has at least one securing means for impeding or preventing the opening of the package, or the access to the products disposed in the inner package, characterized in that the at least one securing means is effective between the inner package and the outer package so as to impede or prevent the inner package being displaced in the outer package in order for the package to be opened. Accordingly it is provided that the at least one securing means is effective between the inner package and the outer package so as to impede or prevent the inner package being displaced in the outer package in order for the package to be opened.

It can preferably be provided that the inner package and the outer package are assigned corresponding latching means as securing means, the latter in the event of a closed package being mutually engaged and specified to be able to be disengaged by the consumer in order for the package to be opened.

Furthermore, it can be provided that the package has a plurality of securing means, and that the package is specified such that at least a plurality, preferably all, of the securing means have to be disengaged by the consumer in order to be able to open the package.

It is preferably provided that securing means are disposed on opposite sides of the package.

It is in particular provided that securing means are disposed at mutually offset planes which run so as to be perpendicular or parallel to a longitudinal central axis of the package.

A peculiarity can lie in that latching means assigned to the inner package are assigned to a security card which is fastened to a lateral wall of the inner package, in particular by being adhesively bonded to the external side of the lateral wall of the inner package.

It is preferably provided that the security card is configured as a planar member which preferably extends across a major part of the lateral wall of the inner package, the latching means being disposed on the periphery of said planar member.

In one preferred embodiment it can be provided that the latching means of the security card are configured as tabs which latch into corresponding clearances in the outer package and which, in the event of a closed package, by the consumer applying pressure to the tabs are able to be disengaged from the clearances in order to be able to open the package.

In one preferred design embodiment it can be provided that the outer package has a cuboid shape with six sides, and that the outer package has a large-area front wall as well as a corresponding opposite rear wall, and that the outer package has two narrow-side walls which in each case connect the front wall and rear wall to one another, and that the outer package is configured as a sleeve and is open in the region of a base side and of an end side opposite the base side.

The inner package preferably has a pivoting lid and the package is specified such that the closed lid of the inner package at least partially bears on a wall of the outer package, preferably on the front wall, so that the lid of the inner package cannot be opened when the inner package has not been at least partially extracted from the outer package.

A further peculiarity can lie in that the inner package on the rear wall possesses incisions which extend across substantially the entire width of the rear wall and transversely to the longitudinal direction of the package, said incisions being disposed at a mutual spacing.

It is furthermore preferably provided that the security card is able to be deformed by pressure on the tabs in such a way that the tabs are able to be disengaged from the clearances.

In a preferred exemplary embodiment, the security card between two incisions is connected to the region of the rear wall of the inner package by adhesive bonding and the region, conjointly with the security card, is able to be deformed by pressure on the tabs.

It can preferably be provided that the tabs of the security card and the associated clearances are in each case disposed in the region of the narrow-side walls, and that the tabs are disposed in the transition to the same large-area side of the package, preferably to the rear wall of the outer package, and that one tab is disposed closer to the base side and the other tab is disposed closer to the end side of the outer package.

It can in particular be provided that a lower closing edge of the pivoting lid of the inner package is contoured in an arcuate manner so as to facilitate the introduction of the inner package into the outer package.

In a preferred embodiment it can be provided that narrow-side walls of the inner package are at least partially configured in two tiers, specifically by an overlap of in each case one outer lateral tab and one inner lateral tab, said tabs preferably being connected to one another by an adhesive, and that a front wall of the pivoting lid of the inner package and a front wall of the box part of the inner package lie flush against one another in the closed position of the inner package.

It is highly preferably provided that the package is specified such that the two tabs of the security card have to be depressed in order for the package to be opened, and the inner package has to be at least partially extracted from the outer package in order for the consumer to be able to open the pivoting lid of the inner package.

BRIEF DESCRIPTION OF THE DRAWINGS

Preferred exemplary embodiments of the invention will be explained hereunder by means of the drawings. In the drawings.

DETAILED DESCRIPTION OF PREFERRED EMBODIMENTS

Figure 2:
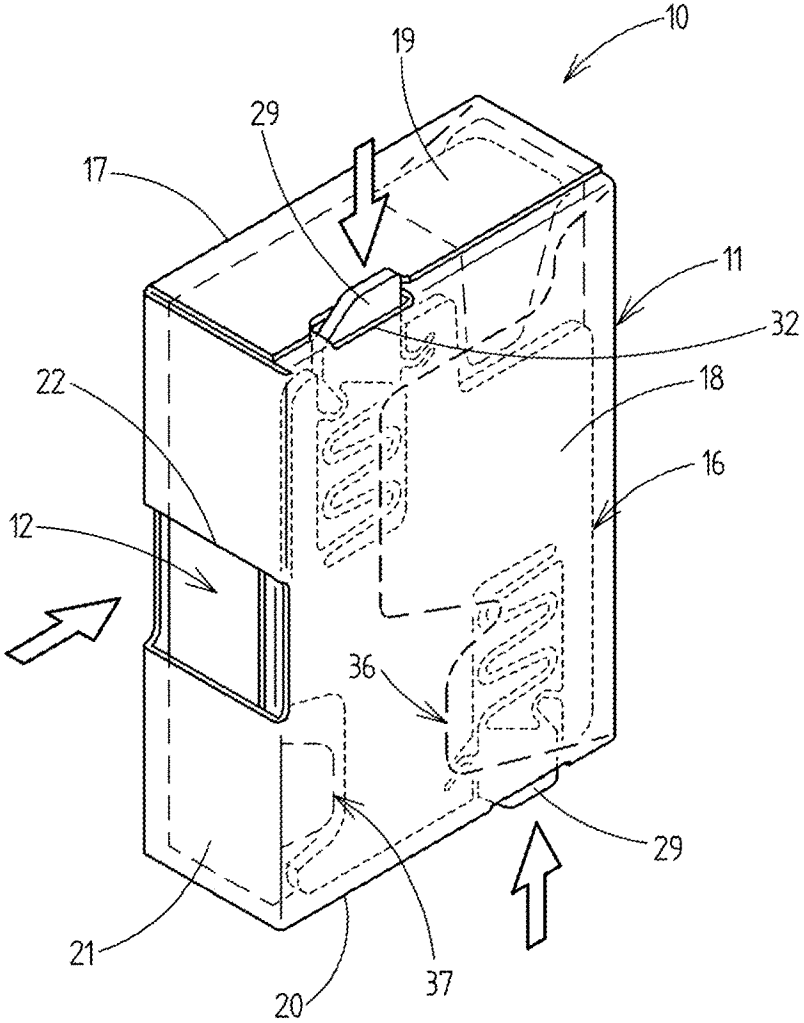
FIG. 2 shows the package according to FIG. 1 in an isometric illustration, in a view onto the rear side.
Figure 1:
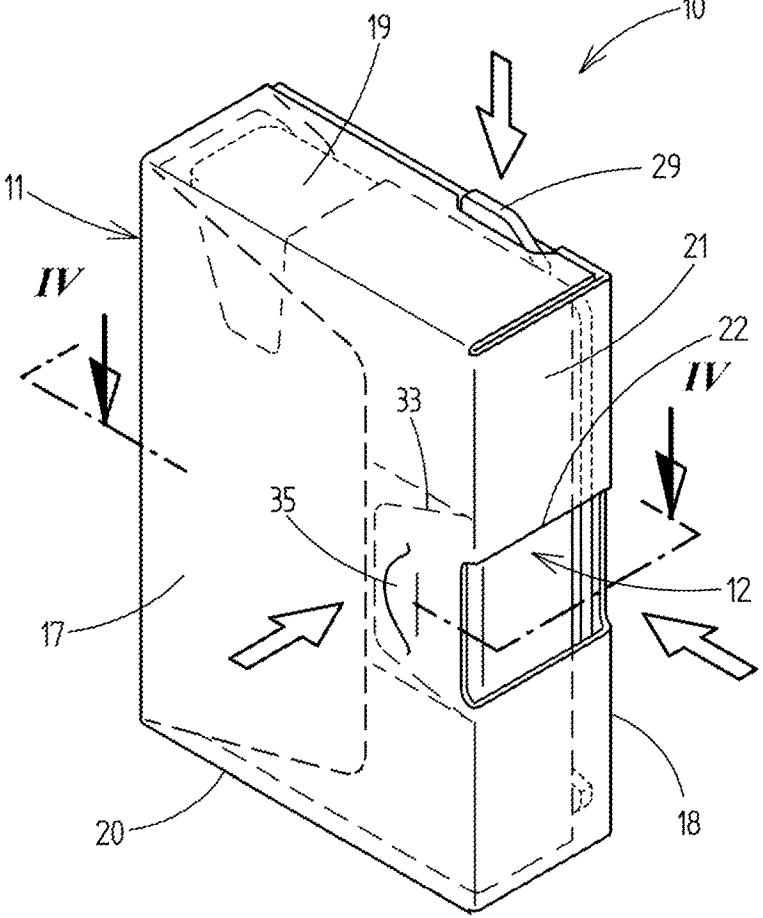
FIG. 1 shows a first exemplary embodiment of a package in an isometric illustration, in a view onto the front side.
Figure 4:
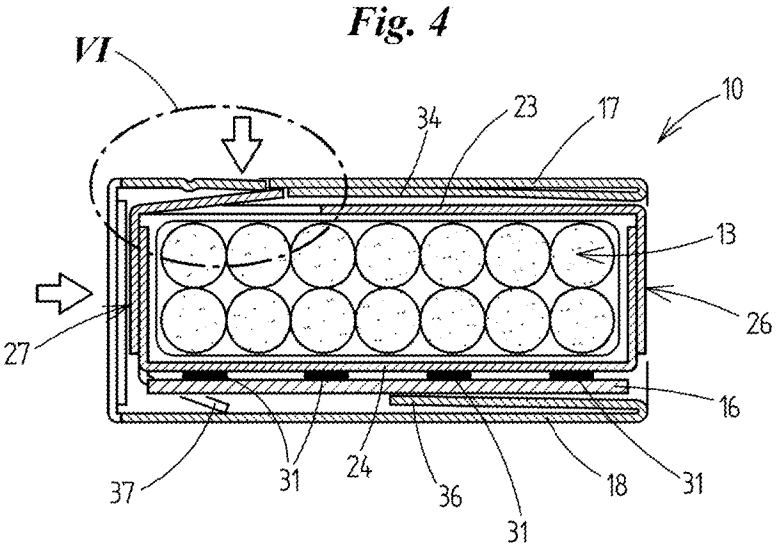
FIG. 4 shows a horizontal section through the package along the section line IV-IV in FIG. 1.

The invention will be explained hereunder by means of five exemplary embodiments. As far as possible, the same terms are used for the same items in all exemplary embodiments here.

All exemplary embodiments have the common feature that the packages 10 shown therein possess an outer package 11 and an inner package 12. The inner package 12 is in each case disposed in the outer package 11 and can at least be partially pushed out of the latter in order to gain access to the package content 13.

The outer package 11 and the inner package 12 in all exemplary embodiments are in each case formed from a separate blank 14, 15 made from packaging material, for example from cardboard. The cuboid outer package 11 and inner package 12, respectively, are formed by folding the respective blanks 14, 15. The shape of the outer package 11 and inner package 12, respectively, is fixed in that individual parts of the folded blanks 14, 15 are connected to one another by adhesive bonding, for example by means of glue.

A peculiarity of the packages 10 lies in that securing means as an anti-tamper feature have to be overcome in order for the respective package 10 to be opened. The securing means are all effective between the inner package 12 and the outer package 11 and serve for impeding the inner package 12 being pushed or extracted or pivoted out of the outer package 11 at least to the extent that the package 10 meets the requirements set for child-proof packages.

The securing means are in each case one or a plurality of tabs (of the inner package 12) which engage in the respective clearances (of the outer package 11), or tabs (of the inner package 12) which engage with tabs (of the outer package 11), respectively. These "latching means" in the event of a closed package mutually engage and have to be disengaged by the consumer in order to be able to open the package 10.

A plurality of securing means are preferably provided per package 10, said securing means being disposed such that it is difficult, in particular for children, to simultaneously activate all securing means such that the package 10 can be opened. Therefore, securing means are preferably disposed on opposite sides and/or so as to be mutually offset. This requires correspondingly large hands and/or a corresponding dexterity in order for the package 10 to be opened, both of which children in particular cannot be expected to possess.

As a further peculiarity, the securing means in all exemplary embodiments are implemented in conjunction with a so-called security card 16. The security card 16 is a planar member which is disposed on a wall of the inner package 12 and is preferably connected to the latter by adhesive bonding.

All further details will be described hereunder in the context of the respective exemplary embodiment.

First Exemplary Embodiment (FIGS. 1 to 9)

In the package 10 according to the first exemplary embodiment, the cuboid outer package 11 possesses six sides. A front wall 17 is situated in the region of the large-area side, and a rear wall 18 is situated opposite the former. On the upper side the outer package 11 has an end wall 19, and opposite the latter a lower-side base wall 20. The end wall 19 and the base wall 20 connect in each case the front wall 17 and the rear wall 18. Furthermore provided on one side is a narrow-side wall 21 which connects the front wall 17, the rear wall 18, the end wall 19 and the base wall 20 to one another. The outer package 11 is open on the opposite side.

The narrow-side wall 21 furthermore possesses an opening 22 by way of which the consumer has access to the inner package 12 situated in the outer package 11, so as to be able to push said inner package 12 out of the outer package 11 by way of the open side. The walls of the outer package 11 are otherwise substantially closed.

The inner package 12, like the outer package 11, is configured so as to be cuboid, likewise having six sides. Like the outer package 11, the inner package 12 possesses a front wall 23, a rear wall 24, a base wall 25 and two narrow-side walls 26, 27 as well as a (partial) end wall 28. The walls of the inner package 12 are situated on the same sides as the corresponding known walls of the outer package 11.

The security card 16 is a further component part of the package 10. Said security card 16 on two sides possesses in each case one tab 29, the latter hereunder for the sake of improved differentiation from further tabs also being referred to as the latching tab 29. Since the latching tab 29 is a tab 29, the same reference sign is utilized for both items here. The latching tabs 29 are in each case connected to the security card 16 by way of a spring element 30. The latching tabs 29 are pushed outward by the spring elements 30 so that said latching tabs 29 protrude beyond a periphery of the security card 16.

The security card 16 in the present case is fastened to the outside of the rear wall 24 of the inner package 12 by adhesive bonding. The adhesive bonding is indicated by glue spots 31 in the drawings. It is understood that other fastenings are also possible.

The security card 16 is sized such that said security card 16 in the present case extends across a large part of the rear wall 24, so that the latching tabs 29 on the upper side and the lower side protrude beyond the rear wall 24, or are correspondingly pushed outward by the spring elements 30, respectively. The latching tabs 29 in this position can latch in correspondingly positioned clearances 32 in the base wall 20 and the end wall 19 of the outer package 11 so that it is impossible for the inner package 12 to be pushed out of the outer package 11. The engagement between the latching tabs 29 and the clearances 32 as the latching means of the security card 16 can be overcome in that the consumer pushes the latching tabs 29, counter to the pre-tensioning of the spring elements 30, into the package 10. The latching tabs 29 here are situated on opposite sides of the security card 16 and are moreover disposed so as to be mutually offset so that the activation of the latching tabs 29 is impeded at least for children.

Further latching means are provided between the front walls 17, 23. A detent tab 33 formed by punched cuts is formed in the front wall 23 of the inner package 12. The front wall 23 by means of an inner tab 34 is configured in two tiers, wherein the detent tab 33 in the event of the closed package 10 is supported on a periphery of the inner tab 34 (FIG. 4) so that the inner package 12 cannot be pushed out of the outer package 11. To this end, the inner tab 34 is fixedly connected to the front wall 23, for example by adhesive bonding.

Figure 6:
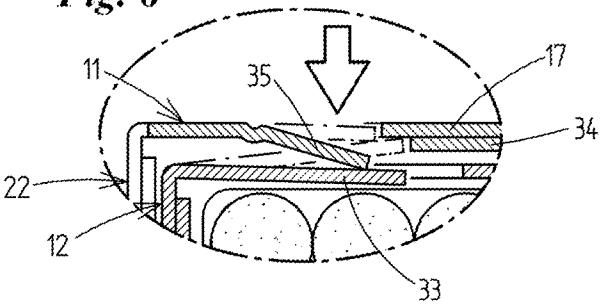
FIG. 6 shows in an enlarged illustration a detail of the package in the region VI in FIG. 4.

In order for this barrier to be overcome, the detent tab 33 can be pushed into the package 10 by the consumer (FIG. 6). To this end, an unlatching tab 35 is formed by punched cuts at a corresponding location in the front wall 17 of the outer package 11. As a result of pressure on the unlatching tab 35, the detent tab 33 is moved to the position according to FIG. 6 so that the inner package 12 can be pushed out of the outer package 11, assuming that the barrier between the latching tabs 29 and the clearances 32 is simultaneously overcome. Since the consumer has to reach through the opening 22 in order for the inner package 12 to be pushed out of the outer package 11, the entire opening procedure is impeded in such a manner that children, or persons with limited dexterity, should really not be able to accomplish this.

A further securing measure relates to a delimitation of the degree to which the inner package 12 can be pushed out of the outer package 11. Latching tabs 36, 37, which mutually interlock when the inner package 12 is pushed out of the outer package 11 (FIG. 5), are configured in the region of the rear walls 18, 24. In this way, the distance by which the inner package 12 can be pushed out of the outer package 11 is delimited. While the latching tab 36 of the outer package 11 is configured as a tab of the blank 15 that is folded inward, the latching tab 37 of the inner package 12 is formed by punched cuts in the rear wall 24. The latching tabs 36, 37 are in each case configured so as to be movable or pivotable, respectively, in order to enable the interlocking action.

The latching tab 36 possesses yet one further function. While a lower region of the latching tab 36 serves for interlocking with the latching tab 37, an upper region of the latching tab 36 extends further than the lower region, extending into the region of the upper spring element 30 such that the latter when pushing out the inner package 12 is protected against canting or buckling, respectively.

Figures 7, 8, 9:
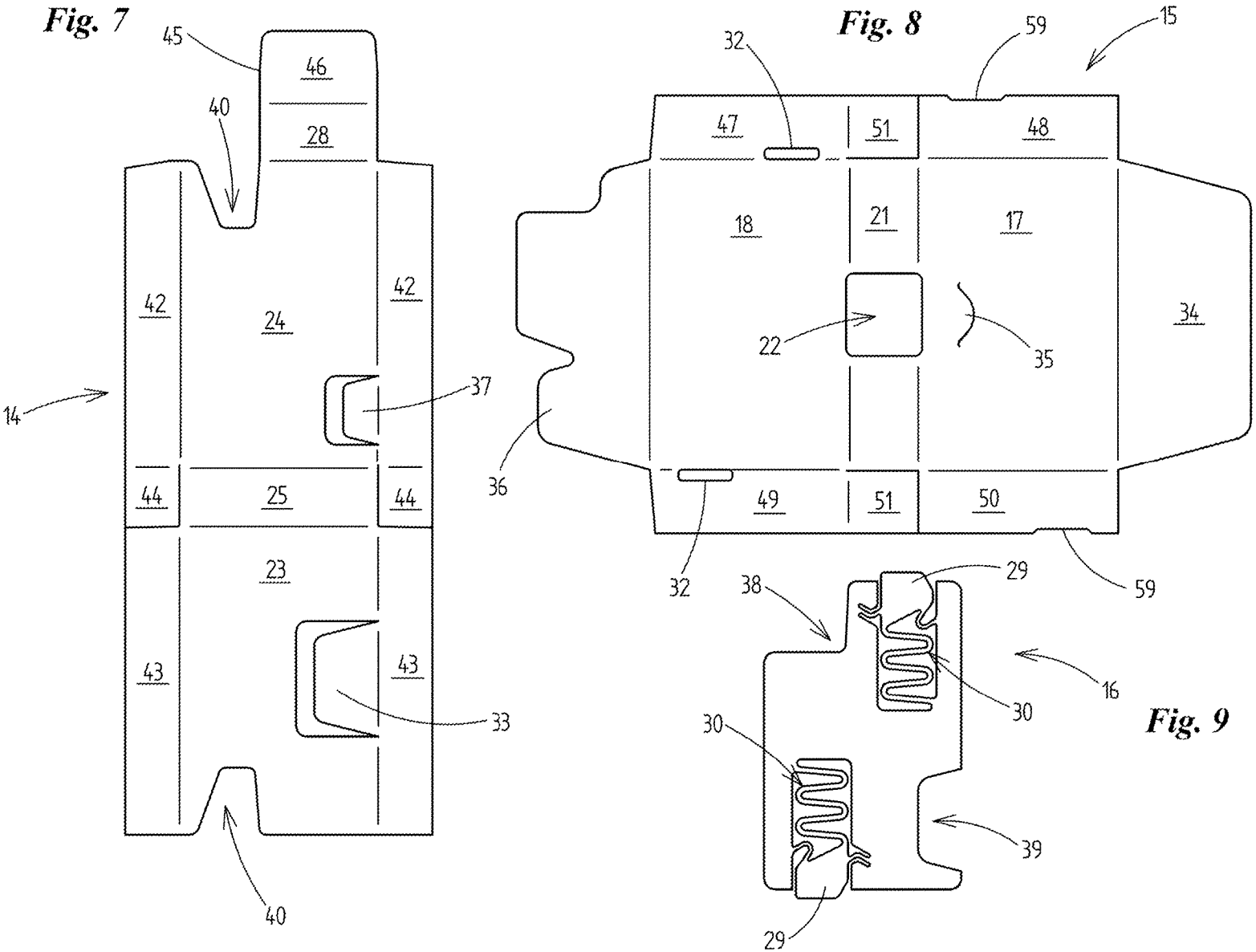
FIG. 7 shows a non-folded blank for the inner package of the package.
FIG. 8 shows a non-folded blank for the outer package of the package.
FIG. 9 shows a lateral view of a security card of the package.

A further peculiarity lies in that the security card 16 has two clearances 38, 39 (FIG. 9). The first clearance 38 is situated in an upper (corner) region of the security card 16. The second clearance is situated in a lower lateral region of the security card 16.

The position of the first clearance 38 is associated with a retrieval opening 40 of the inner package 12. The retrieval opening 40 extends across part of the end wall 28 of the inner package 12 and beyond the latter into the adjacent regions of the front wall 23 and of the rear wall 24. In order for the retrieval opening not to be obscured in the region of the rear wall 24, the security card 16 has the correspondingly positioned and shaped clearance 38.

Figure 5:
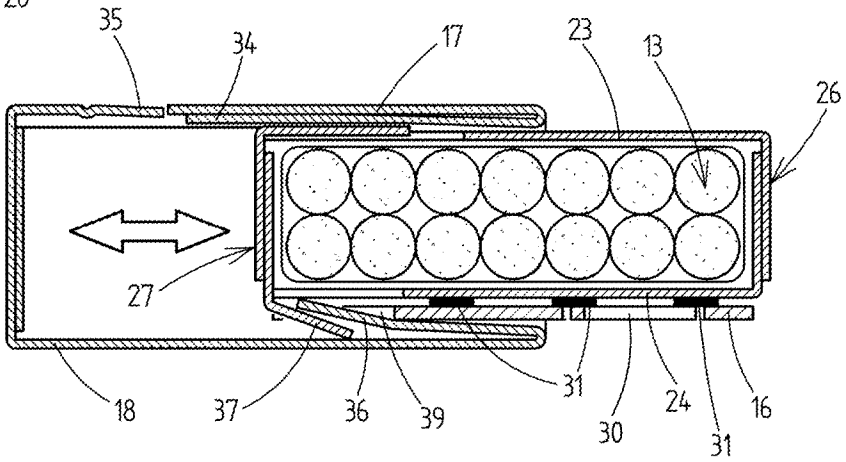
FIG. 5 shows a horizontal section through the package along the section line V-V in FIG. 3.
Figure 3:
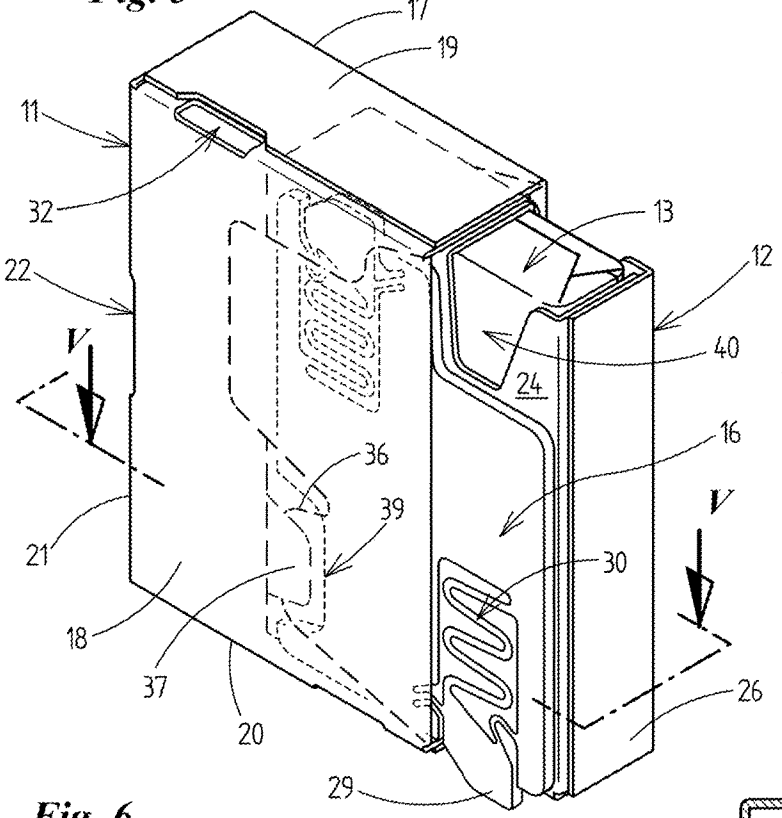
FIG. 3 shows the package according to FIG. 1 in a partially opened position.

The position of the second clearance 39 is associated with the latching tabs 36, 37. As is shown in FIGS. 3 and 5, the clearance 39 is positioned or sized, respectively, so that space is achieved for the interlocking of the latching tabs 36, 37 in the event of an opened package 10.

In the present case, a cigarette group is provided as the package content 13, the latter being wrapped in a casing. It is understood that other products, or other formations or casings, respectively, are also conceivable, as will also be demonstrated by the exemplary embodiments hereunder.

It can be seen in FIG. 7 that narrow-side walls 26, 27 of the inner package 12 are formed by mutually overlapping inner lateral tabs 42 and outer lateral tabs 43 of the blank 14. Furthermore, corner flaps 44 which are folded against the base wall 25 are configured on the blank so as to be between the inner lateral tabs 42 and the outer lateral tabs 43. The partial end wall 28 is formed by a top tab 45 of the blank 14, which is fastened to the front wall 23 via an adjacent connecting tab 46.

It can be seen in FIG. 8 that the end wall 19 of the outer package 11 is formed by an inner top tab 47 and an outer top tab 48 which are disposed so as to mutually overlap. The same applies to the base wall 20 which is formed by an inner base tab 49 and an outer base tab 50 of the blank 15. Here too, corner flaps 51 are in each case disposed between the respective tabs, said corner flaps 51 being folded into the narrow-side wall 21.

Second Exemplary Embodiment (FIGS. 10 to 15)

In the package 10 according to the second exemplary embodiment, the cuboid outer package 11 possesses six sides. A front wall 17 is situated in the region of a large-area side, and a rear wall 18 is situated opposite the former. The outer package 11 is open on the upper side and opposite the latter has a lower-side base wall 20. Furthermore provided on two opposite sides are in each case narrow-side walls 21 which connect the front wall 17, the rear wall 18 and the base wall 20 to one another.

The base wall 20 furthermore possesses an opening 22 by way of which the consumer has access to the inner package 12 situated in the outer package 11, so as to be able to push said inner package 12 out of the outer package 11 by way of the open side. The walls of the outer package 11 otherwise are substantially closed.

Figures 10, 11, 12:
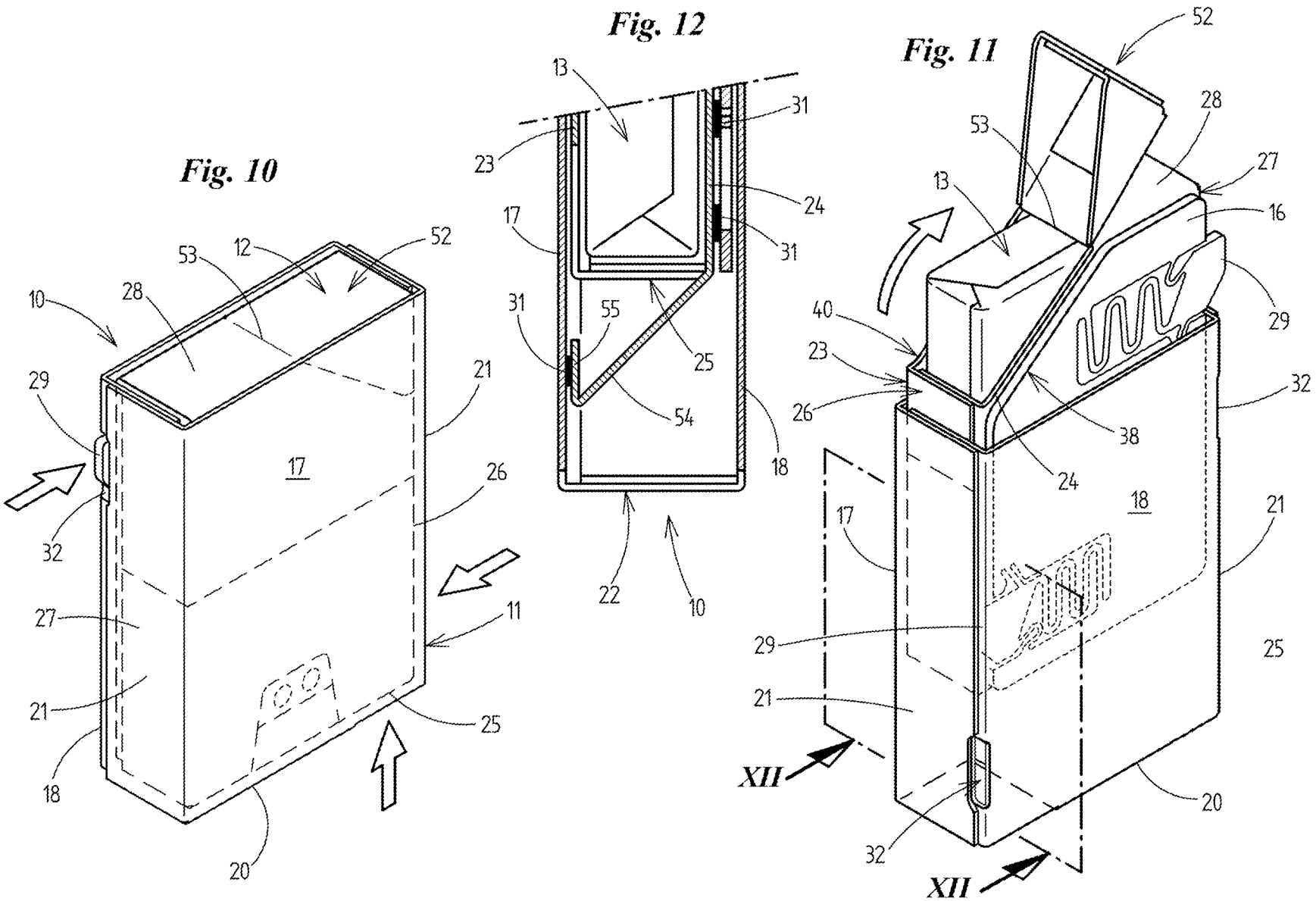
FIG. 10 shows a second exemplary embodiment of a package in an isometric illustration, in a view onto the front side.
FIG. 11 shows the package according to FIG. 10 in an isometric illustration, in a view onto the rear side.
FIG. 12 shows a vertical section through the package along the section line XII-XII in FIG. 11.

The inner package 12, like the outer package 11, is configured so as to be cuboid, likewise having six sides. The inner package 12 possesses a front wall 23, a rear wall 24, a base wall 25 and two narrow-side walls 26, 27 as well as an end wall 28. The walls of the inner package 12 are situated on the same sides as the corresponding known walls of the outer package 11. A pivoting lid 52 which is mounted so as to be pivotable about a linear joint 53 is a further component part of the inner package 12. The linear joint 53 runs parallel to the narrow-side walls 26, 27 so that the pivoting lid 52 can be laterally opened and closed (FIG. 11). The linear joint 53 here runs approximately in the center of the end wall 28.

The security card 16 is a further component part of the package 10. Said security card 16 on two sides possesses in each case one tab 29, the latter hereunder for the sake of improved differentiation from further tabs also being referred to as the latching tab 29. Since the latching tab 29 is a tab 29, the same reference sign is used for both items here. The latching tabs 29 are in each case connected to the security card 16 by way of a spring element 30. The latching tabs 29 are pushed outward by the spring elements 30 such that said latching tabs 29 protrude beyond a periphery of the security card 16.

The security card 16 in the present case is fastened externally to the rear wall 24 of the inner package 12 by adhesive bonding. The adhesive bonding is indicated by glue spots 31 in the drawings. It is understood that other fastenings are also possible.

The security card 16 is sized such that said security card 16 in the present case extends across a large part of the rear wall 24, so that the latching tabs 29 protrude laterally beyond the rear wall 24, or are correspondingly pushed outward by the spring elements 30, respectively. The latching tabs 29 in this position can latch in correspondingly positioned clearances 32 in the narrow-side walls 21 of the outer package 11 so that it is impossible for the inner package 12 to be pushed out of the outer package 11. The engagement between the latching tabs 29 and the clearances 32 as the latching means of the security card 16 can be overcome in that the consumer presses the latching tabs 29, counter to the pre-tensioning of the spring elements 30, into the package 10. The latching tabs 29 here are situated on opposite sides of the security card 16 and are moreover disposed so as to be mutually offset so that the activation of the latching tabs 29 is impeded at least for children.

A further securing measure relates to a delimitation of the degree to which the inner package 12 can be pushed out of the outer package 11. An articulated tab 54 in the region of the base wall 25 and the adjacent front wall of the inner package 12 is delimited by punched cuts. A front end of the articulated tab, specifically a connecting tab 55, is connected to the front wall 17 by glue spots 31 (FIG. 12). In this way, the distance by which the inner package 12 can be pushed out of the outer package 11 is delimited.

Figure 14:
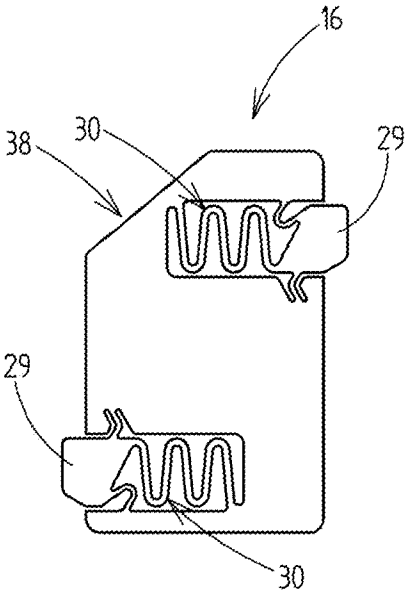
FIG. 14 shows a lateral view of a security card of the package according to FIG. 10.

A further peculiarity lies in that the security card 16 has a clearance 38 (FIG. 14). The first clearance 38 is situated in an upper (corner) region of the security card 16.

The position of the first clearance 38 is associated with the pivoting lid 52, or with the retrieval opening 40 of the inner package 12 that is formed by said pivoting lid 52, respectively. The retrieval opening 40 extends across part of the end wall 28 of the inner package 12, and beyond the latter into the adjacent regions of the front wall 23, the rear wall 24 and a narrow-side wall 26. In order for the security card 16 not to protrude into the retrieval opening 40, the security card 16 has the correspondingly positioned and shaped clearance 38.

A cigarette group is also provided as a package content 13 in this case, said package content 13 being wrapped in a casing. It is understood that other products, or other formations or casings, respectively, are also conceivable, such as is also demonstrated by the exemplary embodiments hereunder.

Figure 13:
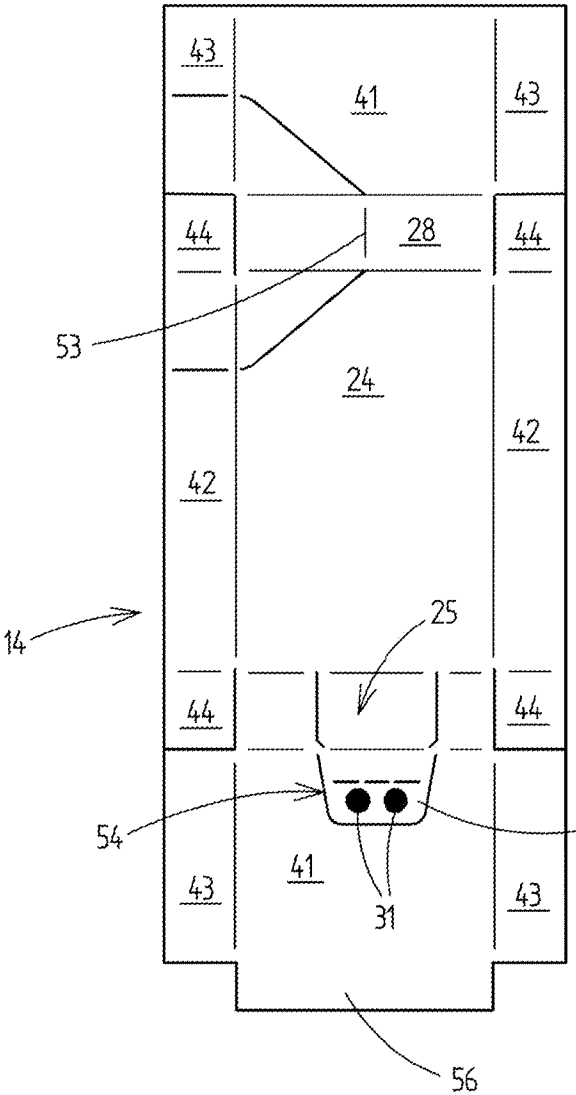
FIG. 13 shows a non-folded blank for the inner package of the package according to FIG. 10.
Figure 17:
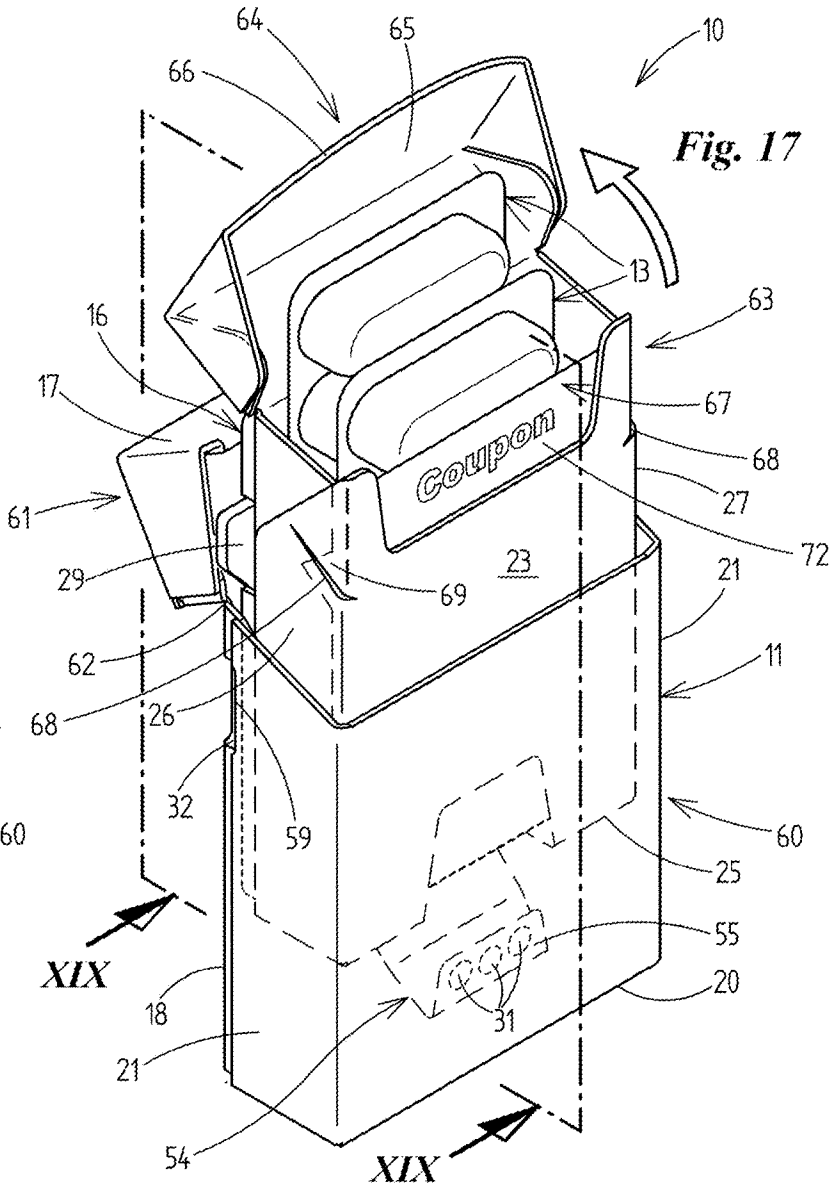
FIG. 17 shows the package according to FIG. 16 in an opened position.
Figure 16:
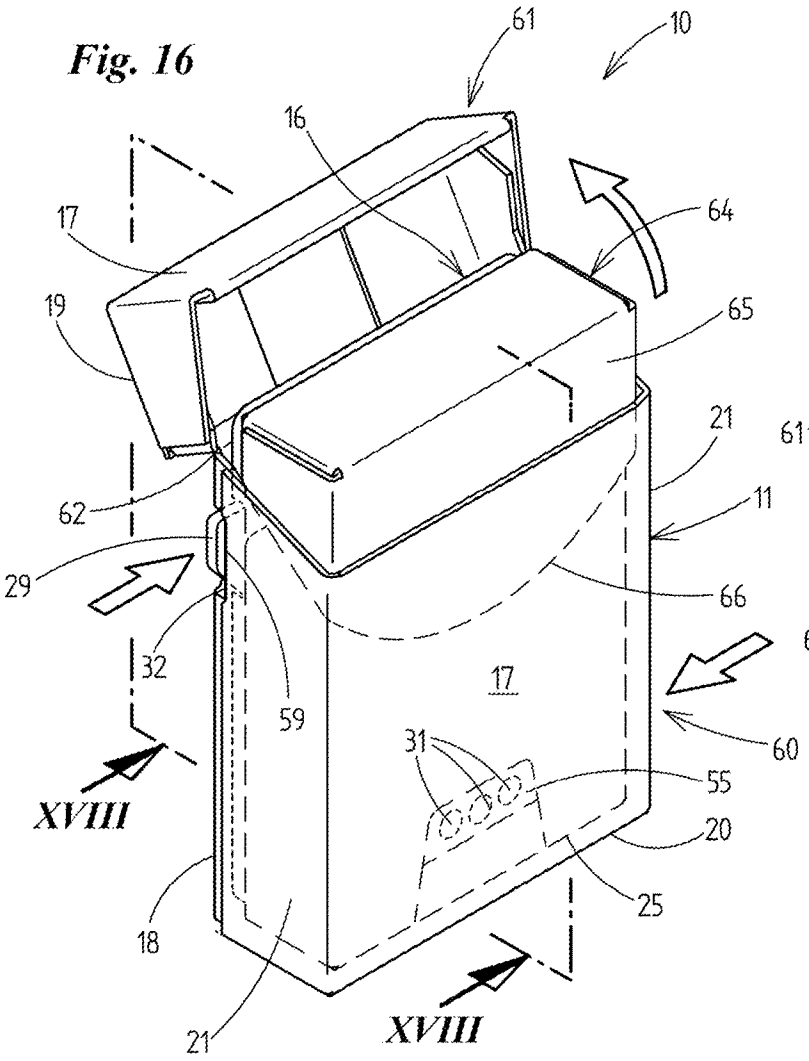
FIG. 16 shows a third exemplary embodiment of a package in an isometric illustration, in a view onto the front side.
Figure 18:
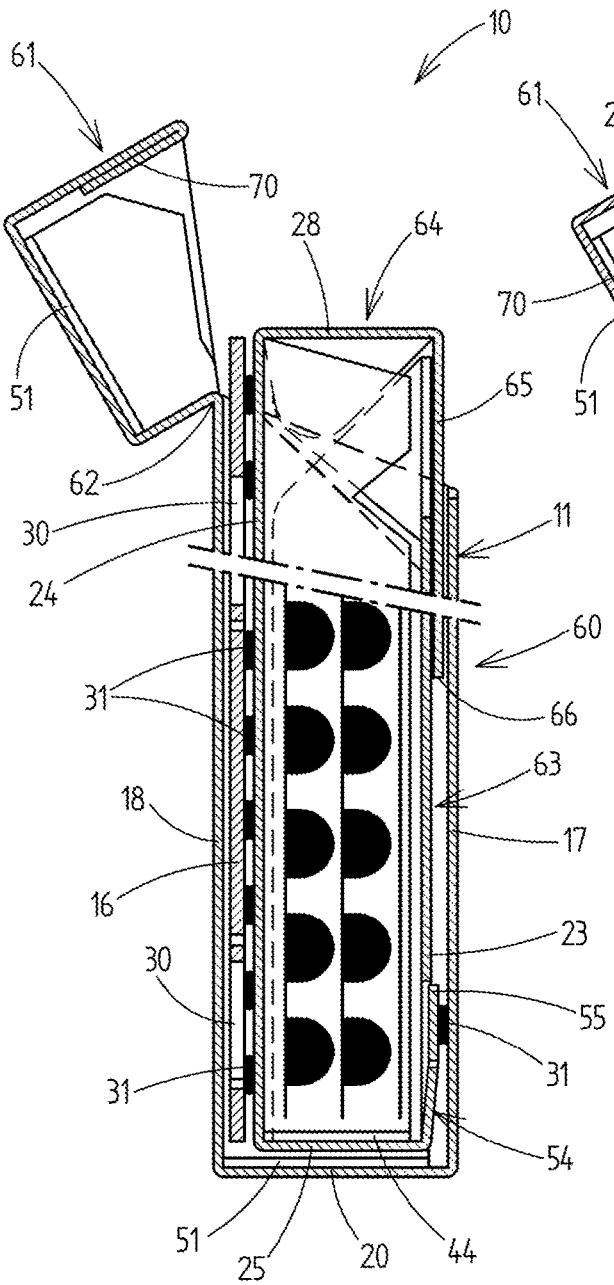
FIG. 18 shows a vertical section through the package according to FIG. 16 along the section line XVIII-XVIII in FIG. 16.
Figure 19:
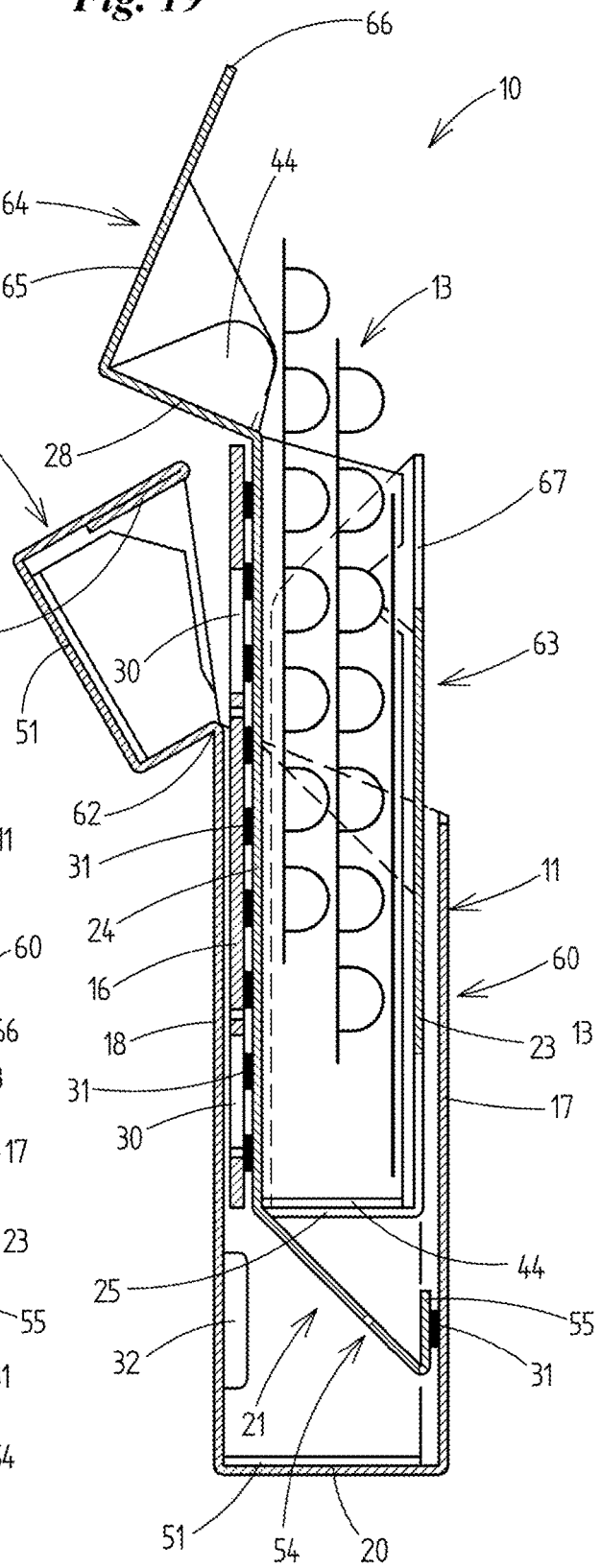
FIG. 19 shows a vertical section through the package according to FIG. 17 along the section line XIX-XIX in FIG. 17.

It can be seen in FIG. 13 that narrow-side walls 26, 27 of the inner package 12 are formed by mutually overlapping inner lateral tabs 42 and outer lateral tabs 43 of the blank 14. Furthermore, corner flaps 44 on the blank 14 are also configured so as to be between the inner lateral tabs 42 and the outer lateral tabs 43, said corner flaps 44 being folded against the base wall 25, or the end wall 28, respectively. The front wall 23 is formed by two folding flaps 41 which are positioned on opposite ends of the blank 14. Furthermore, an overlapping tab 56 is also provided on one of the folding flaps 41.

Figure 15:
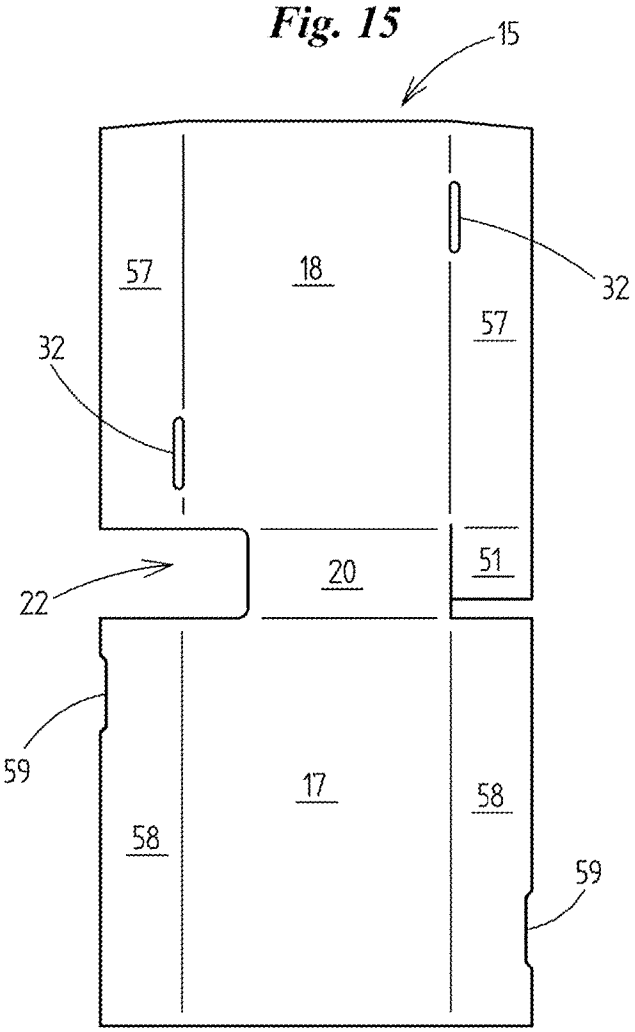
FIG. 15 shows a non-folded blank for the outer package of the package according to FIG. 10.

It can be seen in FIG. 15 that the narrow-side walls 21 of the outer package 11 are formed by mutually overlapping inner lateral tabs 57 and outer lateral tabs 58 of the blank 15. Here too, a corner flap 51 which is folded into the base wall 20 is disposed on one side, so as to be between the respective tabs. Punched cuts 59 for the clearances 32 are disposed in the inner lateral tabs 57 and the outer lateral tabs 58.

Third Exemplary Embodiment (FIGS. 16 to 22)

In the package 10 according to the third exemplary embodiment, the cuboid outer package 11 possesses six sides. A front wall 17 is situated in the region of a large-area side, and a rear wall 18 is situated opposite the former. On the upper side the outer package 11 has an end wall 19, and opposite the latter a lower-side base wall 20. Furthermore provided on two opposite sides are in each case narrow-side walls 21 which connect the front wall 17, the rear wall 18, the end wall 19 and the base wall 20 to one another.

Figure 22:
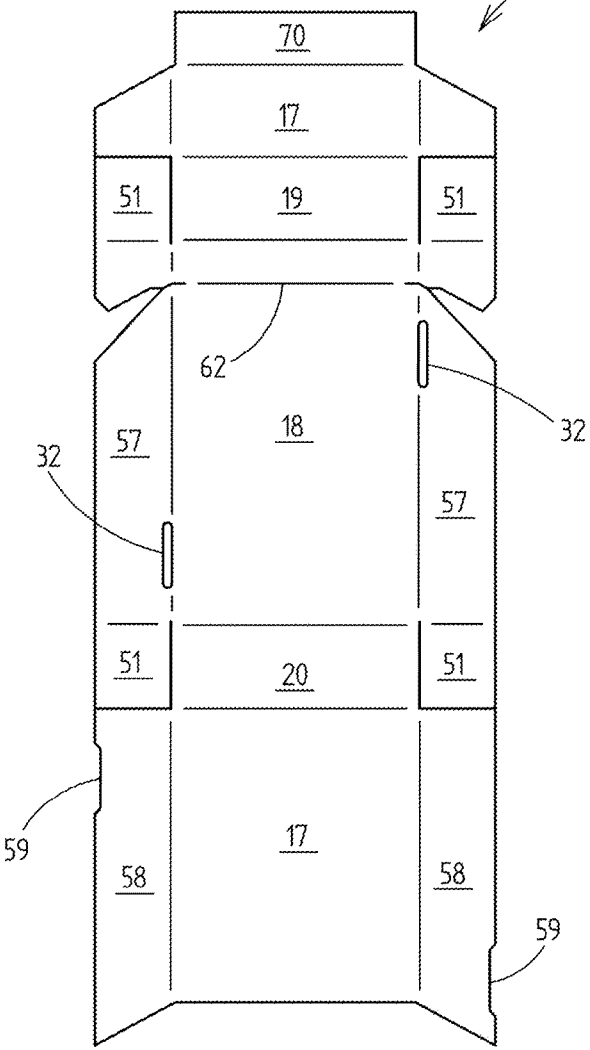
FIG. 22 shows a non-folded blank for the outer package of the package according to FIG. 16.
Figure 21:
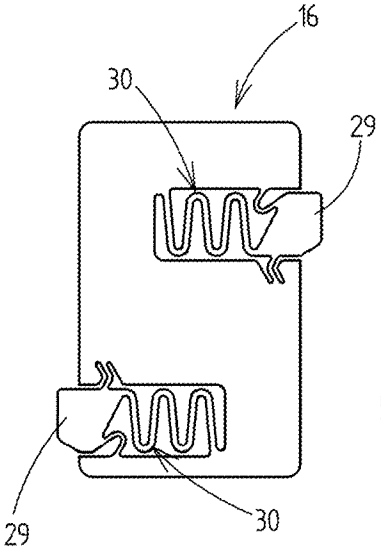
FIG. 21 shows a lateral view of a security card of the package according to FIG. 16.

The outer package 11 is formed from a blank 15 which corresponds substantially to a customary blank for a hinge-lid package (FIG. 22). The outer package 11 accordingly possesses a (lower) box part 60 and an upper pivoting lid 61. The pivoting lid 61 in the usual manner is pivotable about a linear joint 62 disposed on the rear wall 18.

The inner package 12 is also configured as a hinge-lid package and possesses a box part 61 and a pivoting lid 64. Like the outer package 11, the inner package 12 possesses six sides. A front wall 23 is situated in the region of a large-area side, and a rear wall 24 is situated opposite the former. On the upper side the inner package 12 has an end wall 28, and opposite the latter a lower-side base wall 25. Furthermore provided on two opposite sides are in each case narrow-side walls 26, 27 which connect the front wall 23, the rear wall 24, the end wall 28 and the base wall 25 to one another.

The security card 16 is a further component part of the package 10. Said security card 16 on two sides possesses in each case one tab 29, the latter hereunder for the sake of improved differentiation from further tabs also being referred to as the latching tab 29. Since the latching tab 29 is a tab 29, the same reference sign is utilized for both items here. The latching tabs 29 are in each case connected to the security card 16 by way of a spring element 30. The latching tabs 29 are pushed outward by the spring elements 30 so that said latching tabs 29 protrude beyond a periphery of the security card 16.

The security card 16 in the present case is fastened externally to the rear wall 24 of the inner package 12 by adhesive bonding. The adhesive bonding is indicated by glue spots 31 in the drawings. It is understood that other fastenings are also possible.

The security card 16 is sized such that said security card 16 in the present case extends across a large part of the rear wall 24, so that the latching tabs 29 protrude laterally beyond the rear wall 24, or are correspondingly pushed outward by the spring elements 30, respectively. The latching tabs 29 in this position can latch in correspondingly positioned clearances 32 in the narrow-side walls 21 of the outer package 11 so that it is impossible for the inner package 12 to be pushed out of the outer package 11. The engagement between the latching tabs 29 and the clearances 32 as the latching means of the security card 16 can be overcome in that the consumer presses the latching tabs 29, counter to the pre-tensioning of the spring elements 30, into the package 10. The latching tabs 29 here are situated on opposite sides of the security card 16 and are moreover disposed so as to be mutually offset so that the activation of the latching tabs 29 is impeded at least for children.

A further securing measure relates to a delimitation of the degree to which the inner package 12 can be pushed out of the outer package 11. An articulated tab 54 in the region of the base wall 25 and the adjacent front wall of the inner package 12 is delimited by punched cuts. A front end of the articulated tab, specifically a connecting tab 55, is connected to the front wall 17 by glue spots 31. In this way, the distance by which the inner package 12 can be pushed out of the outer package 11 is delimited. Incidentally, this takes place in that the consumer opens the outer package 11 and extracts the inner package 12 by the pivoting lid 64 thereof somewhat out of the outer package 11 until the pivoting lid 64 can be opened. The package 10 here is configured such that a front wall 65 of the pivoting lid 64 bears on the front wall 17 of the outer package 11 such that the pivoting lid 64 cannot be opened before the inner package 12 has not been extracted from the outer package 12 by a corresponding degree. When closing the package 10, the front wall 65 has to be accordingly threaded behind the front wall 17. To this end, a lower closing edge 66 of the pivoting lid 64 of the inner package 12 is contoured in an arcuate manner so as to facilitate the introduction.

A further peculiarity of the package 10 lies in that the front wall 23 in the region of the box part 63 is extended in length in comparison to a conventional package 10. To this end it is provided that the front wall 23 of the inner package 12 on both sides of a central clearance 67 at least partially protrudes beyond the adjacent narrow-side walls 26, 27 of the inner package 12.

It is furthermore to be emphasized that the narrow-side walls 26, 27 of the inner package 12 are at least partially configured in two tiers, specifically by an overlap of in each case one outer lateral tab 43 and one inner lateral tab 42, said tabs 43, 42 being preferably connected to one another by an adhesive, and that one slot 68 which serves as a detent for a lower edge of the pivoting lid 64 of the inner package 12 in the closed position is in each case provided in the outer lateral tabs 43. The lateral shoulders on both sides of the clearance 67 serve as a lateral guide of the pivoting lid 64 when closing the inner package 12. Furthermore, the inner lateral tabs 42 in the region of the slot 68 have a peripheral clearance 69 by way of which the lateral guiding of the pivoting lid 64 is facilitated.

In this case, two blister packs which are not trapped in a casing are provided as the package content 13.

Figure 20:
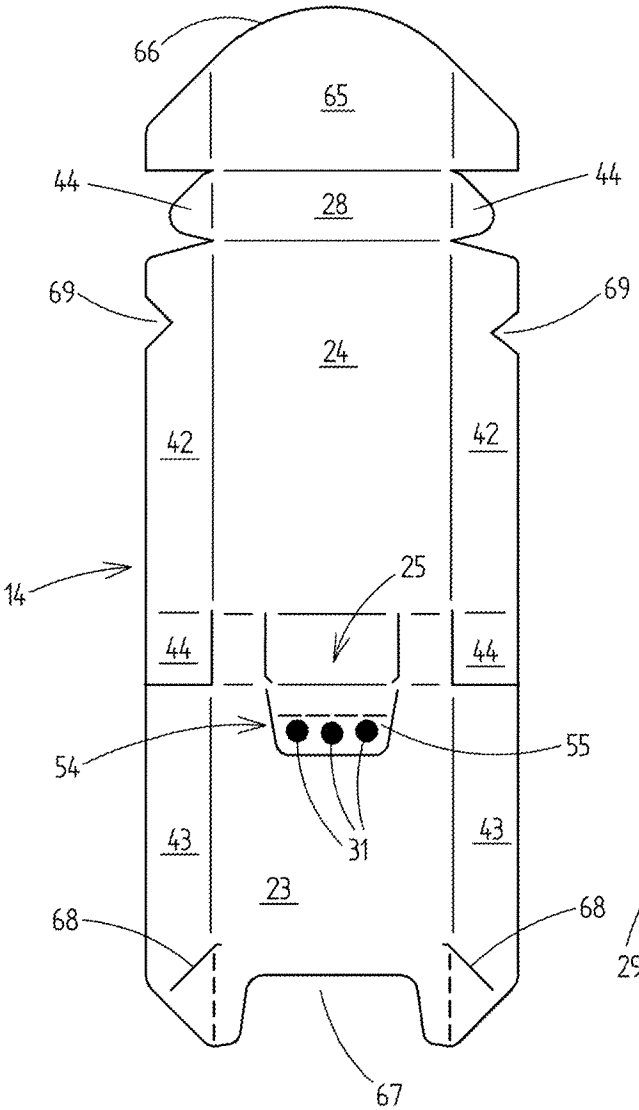
FIG. 20 shows a non-folded blank for the inner package of the package according to FIG. 16.
Figure 24:
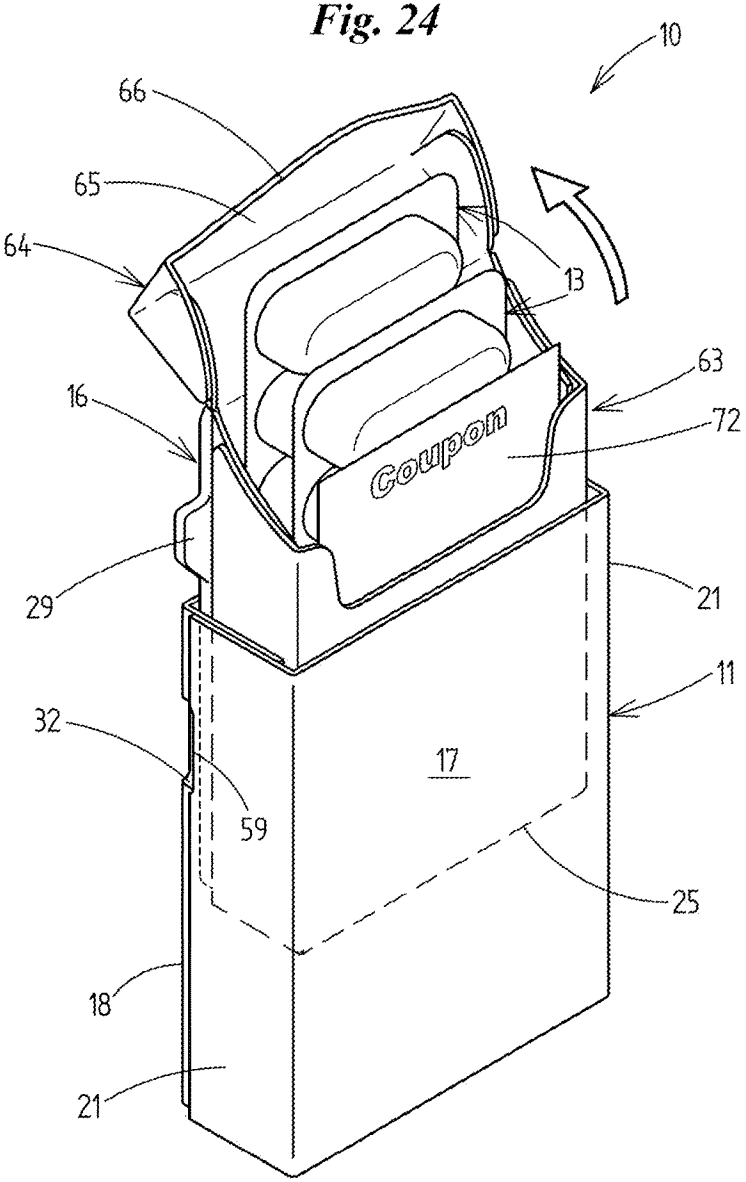
FIG. 24 shows the package according to FIG. 23 in an opened position.
Figure 23:
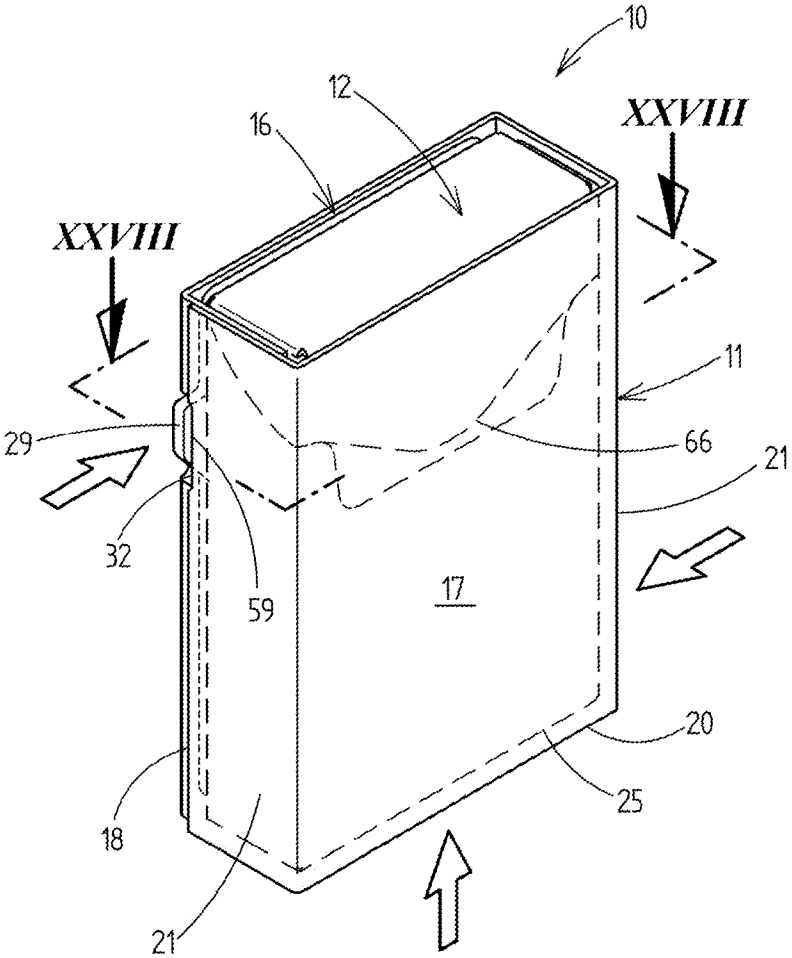
FIG. 23 shows a fourth exemplary embodiment of a package in an isometric illustration, in a view onto the front side.

It can be seen from FIG. 20 that narrow-side walls 26, 27 of the inner package 12 are formed by mutually overlapping inner lateral tabs 42 and outer lateral tabs 43 of the blank 14. Furthermore, corner flaps 44 on the blank 14 are also configured so as to be between the inner lateral tabs 42 and the outer lateral tabs 43, said corner flaps 44 being folded against the base wall 25, or the narrow-side walls 26, 27, respectively.

It can be seen in FIG. 22 that the narrow-side walls 21 of the outer package 11 are formed by mutually overlapping inner lateral tabs 57 and outer lateral tabs 58 of the blank 15. Here too, on both sides a corner flap 51 which is folded into the base wall 20 is disposed between the respective tabs. Further corner flaps 51 are situated on both sides of the end wall 19. Punched cuts 59 for the clearances 32 are disposed in the outer lateral tabs 58. A lid inside flap 70 which is folded against the inside of the front wall 17 in the region of the pivoting lid 61 is configured on a periphery of the blank 15.

Fourth Exemplary Embodiment (FIGS. 23 to 28)

In the package 10 according to the fourth exemplary embodiment, the cuboid outer package 11 possesses six sides. A front wall 17 is situated in the region of a large-area side, and a rear wall 18 is situated opposite the former. The outer package 11 is open on the upper side and the lower side. Furthermore provided on two opposite sides are in each case narrow-side walls 21 which connect the front wall 17 and the rear wall 18 to one another. Accordingly, the outer package 11 is configured as a sleeve.

Figure 26:
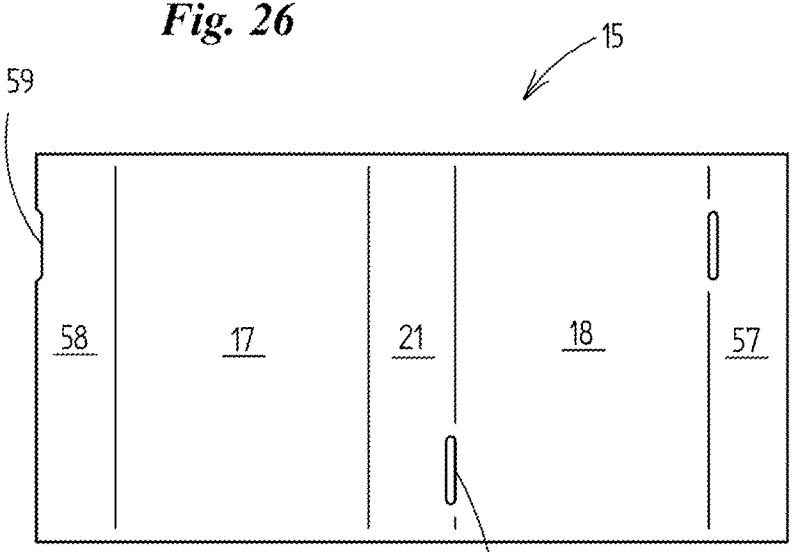
FIG. 26 shows a non-folded blank for the outer package of the package according to FIG. 23.
Figure 27:
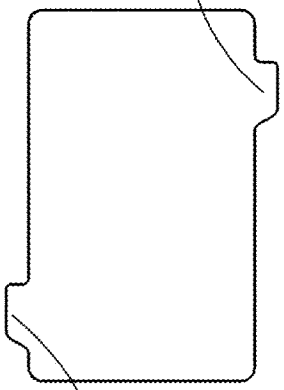
FIG. 27 shows a lateral view of a security card of the package according to FIG. 23.

The outer package 11 is formed from a blank 15, which essentially corresponds to a customary blank for a sleeve (FIG. 26).

The inner package 12, as in the third exemplary embodiment, is configured as a hinge-lid package and possesses a box part 63 and a pivoting lid 64. Like the outer package 11, the inner package 12 possesses six sides. A front wall 23 is situated in the region of a large-area side, and a rear wall 24 is situated opposite the former. On the upper side the inner package 12 has an end wall 28 and opposite the latter possesses a lower-side base wall 25. Furthermore provided on two opposite sides are in each case narrow-side walls 26, 27 which connect the front wall 23, the rear wall 24, the end wall 28 and the base wall 25 to one another.

The security card 16 is a further component part of the package 10. Said security card 16 on two sides possesses in each case one tab 29 which hereunder for the sake of better differentiation from further tabs is also referred to as the latching tab 29. Since the latching tab 29 is a tab 29, the same reference sign is used for both items here. The latching tabs 29 in this case are rigidly connected to the security card 16. The latching tabs 29 here are disposed such that the latter project beyond a periphery of the security card 16.

The security card 16 in the present case is fastened externally to the rear wall 24 of the inner package 12 by adhesive bonding. The adhesive bonding is indicated by glue spots 31 in the drawings. It is understood that other fastenings are also possible.

Figure 28:
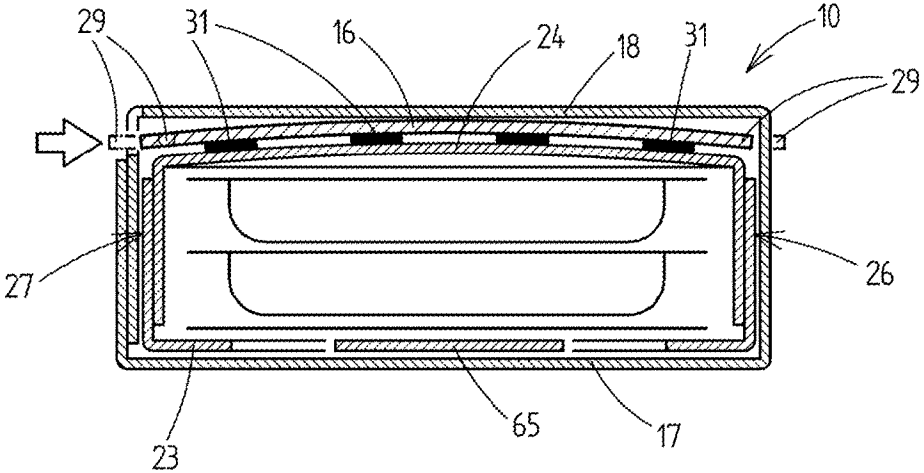
FIG. 28 shows a horizontal section through the package along the section line XXVIII-XXVIII in FIG. 23.

The security card 16 is again sized such that said security card 16 in the present case extends across a large part of the rear wall 24, so that the latching tabs 29 protrude laterally beyond the rear wall 24. The latching tabs 29 in this position can latch in correspondingly positioned clearances 32 in the narrow-side walls 21 of the outer package 11 so that it is impossible for the inner package 12 to be pushed out of the outer package 11. The engagement between the latching tabs 29 and the clearances 32 as the latching means of the security card 16 can be overcome in that the consumer deforms the security card 16 by pressing the latching tabs 29, and thereby presses the security card 16 into the package 10 (FIG. 28). The latching tabs 29 here are situated on opposite sides of the security card 16 and are moreover disposed so as to be mutually offset so that the activation of the latching tabs 29 is impeded at least for children.

When the inner package 12 is pushed into the outer package 11 (closed package 10/FIG. 23), the front wall 65 of the pivoting lid 64 of the inner package 12 bears on the front wall 17 of the outer package 11 so that the pivoting lid 64 cannot be opened. The pivoting lid 64 can be opened only once the consumer in a corresponding manner has pushed the inner package 12 out of the outer package 11 by way of the upper open side of the latter.

The pushing-out here is performed by pressure on the base wall 25 of the inner package 12. It is understood that the securing means moreover have to be unlocked. When closing the package 10, the front wall 65 has to be correspondingly threaded behind the front wall 17. To this end, a lower closing edge 66 of the pivoting lid 64 of the inner package 12 is contoured in an arcuate manner so as to facilitate the introduction.

As a further peculiarity it is provided that the inner package 12 on the rear wall 24 possesses incisions 71 which extend across substantially the entire width of the rear wall 24 and transversely to the longitudinal direction of the package 10, said incisions being disposed at a mutual spacing. It is furthermore provided that the security card 16 between the two incisions 71 is connected to the region of the rear wall 24 of the inner package 12 by adhesive bonding, and that this region of the rear wall 24, conjointly with the security card 16, is able to be deformed by pressure on the tabs 29.

The security card 16 is preferably composed of an elastically deformable material such as, for example, a plastic film or card, respectively.

Figure 25:
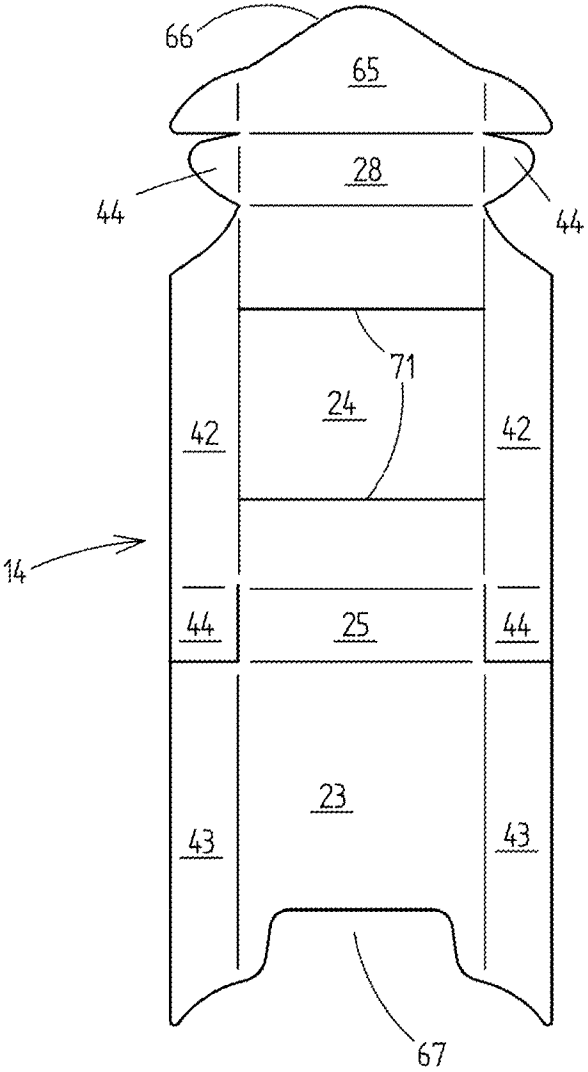
FIG. 25 shows a non-folded blank for the inner package of the package according to FIG. 23.

It can furthermore be seen in FIG. 25 that the narrow-side walls 26, 27 of the inner package 12 are formed by mutually overlapping inner lateral tabs 42 and outer lateral tabs 43 of the blank 14. Furthermore, corner flaps 44 on the blank 15 are also configured between the inner lateral tabs 42 and the outer lateral tabs 43, said corner flaps 44 being folded against the base wall 25 or the narrow-side walls 26, 27, respectively.

It can be seen in FIG. 26 that a narrow-side wall of the outer package 11 is formed by mutually overlapping inner lateral tabs 57 and outer lateral tabs 58 of the blank 15. Punched cuts 59 for the clearances 32 are disposed in the outer lateral tabs 58.

Fifth Exemplary Embodiment (FIGS. 29 to 36)

In the package 10 according to the fifth exemplary embodiment, the cuboid outer package 11 possesses six sides. A front wall 17 is situated in the region of a large-area side, and a rear wall 18 is situated opposite the former. On the upper side the outer package 11 has an end wall 19. The end wall 19 connects in each case the front wall 17 and the rear wall 18. Furthermore provided on one side is a narrow-side wall 21 which connects the front wall 17, the rear wall 18, the end wall 19 to one another. The outer package 11 is open on that side that lies opposite the narrow-side wall 21. Likewise, the outer package is open opposite the end wall 19.

The narrow-side wall 21 furthermore possesses an opening 22 by way of which the consumer has access to the inner package 12 which is situated in the outer package 11, so as to be able to pivot said inner package 12 out of the outer package 11 by way of the open sides. The walls of the outer package 11 otherwise are substantially closed.

The inner package 12, like the outer package 11, is configured so as to be cuboid, likewise having six sides. Like the outer package 11, the inner package 12 possesses a front wall 23, a rear wall 24, a base wall 25 and two narrow-side walls 26, 27 as well as a (partial) end wall 28. The walls of the inner package 12 are situated on the same sides as the corresponding known walls of the outer package 11.

The security card 16 is a further component part of the package 10. Said security card 16 on one side possesses a tab 29, the latter hereunder for the sake of improved differentiation from further tabs also being referred to as the latching tab 29. Since the latching tab 29 is a tab 29, the same reference sign is utilized for both items here. The latching tab 29 is connected to the security card 16 by way of a spring element 30. The latching tab 29 is pushed outward by the spring element 30 so that said latching tab 29 protrudes beyond a periphery of the security card 16.

The security card 16 in the present case is fastened internally to the rear wall 24 of the inner package 12 by adhesive bonding. The adhesive bonding is indicated by glue spots 31 in the drawings. It is understood that other fastenings are also possible.

The security card 16 is sized such that said security card 16 in the present case extends across a large part of the rear wall 24, so that the latching tab 29 on the upper side protrudes beyond the rear wall 24, or is correspondingly pushed out by the spring element 30, respectively. The latching tab 29 in this position can latch in a correspondingly positioned clearance 32 in the end wall 19 of the outer package 11 such that it is impossible for the inner package 12 to be pivoted out of the outer package 11. The engagement between the latching tab 29 and the clearance 32 as the latching means of the security card 16 can be overcome in that the consumer pushes the latching tab 29, counter to the pre-tensioning of the spring element 30, into the package 10.

Since the security card in this exemplary embodiment is disposed or attached in the inner package 12, the inner package 12 also has a clearance 32, the tab 29 protruding through the latter. The clearances 32 in the outer package 11 and the inner package 12 are positioned in a mutually corresponding manner.

Further latching means are provided between the front walls 17, 23. A detent tab 33, formed by punched cuts, is formed in the front wall 23 of the inner package 12. The front wall 17 by means of an inside tab 34 is configured in two tiers, wherein the detent tab 33 in the event of a closed package 10 is supported on a periphery of the inside tab 34 (FIG. 31) so that the inner package 12 cannot be pivoted out of the outer package 11. To this end, the inside tab 34 is fixedly connected to the front wall 17, for example by adhesive bonding. A corresponding construction can also be found on the opposite side of the package, between the rear walls 18, 24.

Figure 32:
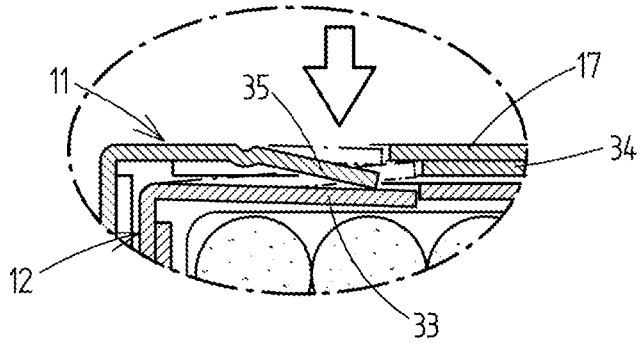
FIG. 32 shows a detail of the package in the region XXXII according to FIG. 31.
Figure 33:
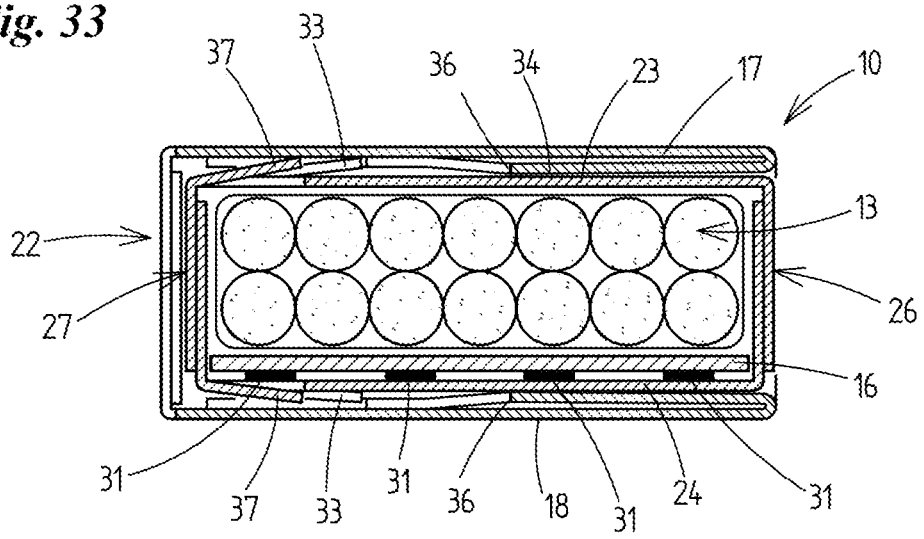
FIG. 33 shows a horizontal section through the package along the section line XXXIII-XXXIII in FIG. 29.

In order to be able to overcome this barrier, the detent tabs 33 can be pushed into the package 10 by the consumer (FIG. 32). To this end, one unlatching tab 35 is in each case formed by punched cuts at corresponding locations in the front wall 17 and the rear wall 18 of the outer package 11. The detent tabs 33 are moved to the position according to FIG. 32 by pressure on the unlatching tabs 35, such that the inner package 12 can be pivoted out of the outer package 11, assuming that the barrier between the latching tab 29 and the clearance 32 in the outer package 11 is simultaneously overcome. Since the consumer has to reach through the opening 22 in order for the inner package 12 to be pivoted out of the outer package 11, the entire opening procedure is impeded in such a manner that children or persons with limited dexterity should really not be able to accomplish this.

A further securing measure relates to a delimitation of the degree to which the inner package 12 can be pivoted out of the outer package 11. Latching tabs 36, 37, which mutually interlock when the inner package 12 is pivoted out of the outer package 11, are configured in the region of the rear walls 18, 24 and the front walls 17, 23. In this way, the distance by which the inner package 12 can be pivoted out of the outer package 11 is delimited. While the latching tabs 36 of the outer package 11 are configured as tabs of the blank 15 that are folded inward, the latching tabs 37 of the inner package 12 are formed by punched cuts in the front wall 23 and the rear wall 24. The latching tabs 36, 37 are in each case configured so as to be movable or pivotable, respectively, so as to enable the interlocking action. The construction corresponds substantially to that of the first exemplary embodiment so that additional reference may be made to the associated FIG. 5.

Figure 36:
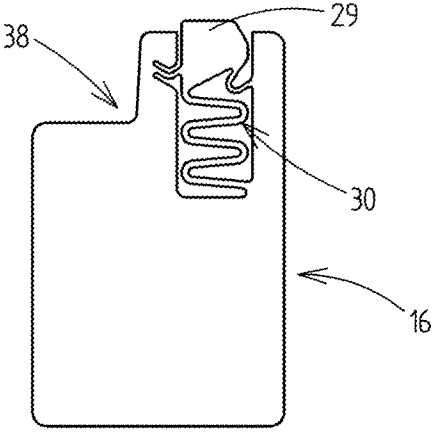
FIG. 36 shows a lateral view of a security card of the package according to FIG. 29.

A further peculiarity lies in that the security card 16 has a clearance 38 (FIG. 36). The clearance 38 is situated in an upper (corner) region of the security card 16. The position of the clearance 38 is associated with a retrieval opening 40 of the inner package 12. The retrieval opening 40 extends across part of the end wall 28 of the inner package 12, and beyond the latter into the adjacent regions of the front wall 23 and of the rear wall 24. In order for the retrieval opening not to be obscured in the region of the rear wall 24, the security card 16 has the correspondingly positioned and shaped clearance 38.

In the present case, a cigarette group is provided as the package content 13, the latter being wrapped in a casing. It is understood that other products, or other formations or casings, respectively, are also conceivable. The cigarette group wrapped in the casing, conjointly with the security card 16, is disposed in the inner package 12.

Figure 34:
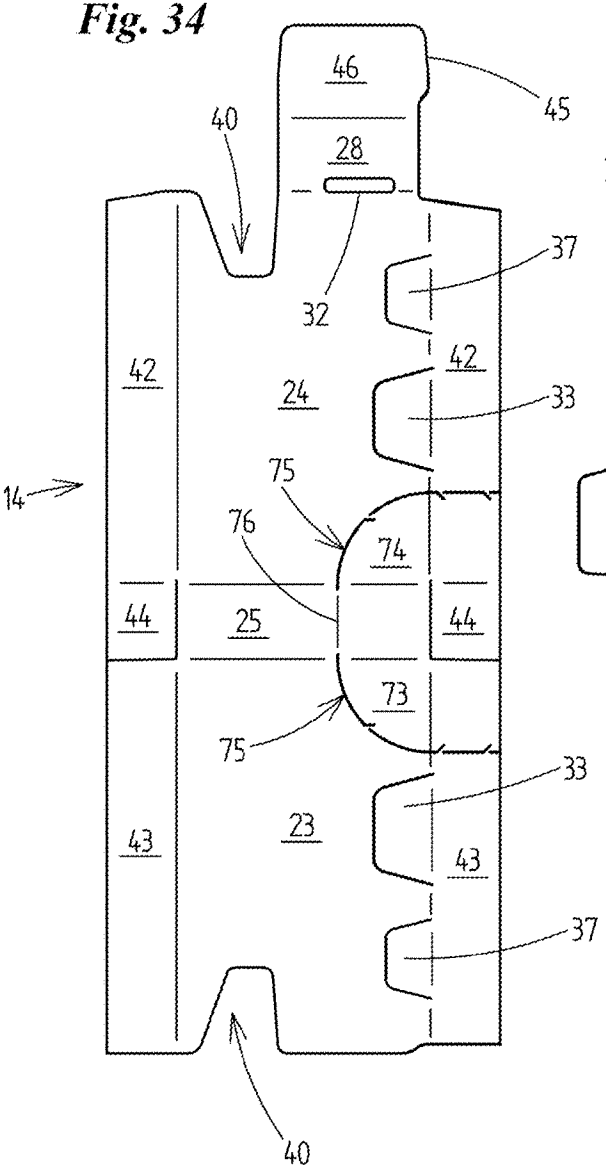
FIG. 34 shows a non-folded blank for the inner package of the package according to FIG. 29.

It can be seen in FIG. 34 that narrow-side walls 26, 27 of the inner package 12 are formed by mutually overlapping inner lateral tabs 42 and outer lateral tabs 43 of the blank 14. Furthermore, corner flaps 44 which are folded against the base wall 25 are also configured on the blank so as to be between the inner lateral tabs 42 and the outer lateral tabs 43. The partial end wall 28 is formed by a top tab 45 of the blank 14, said top tab 45 being fastened to the front wall 23 by way of an adjoining connecting tab 46.

Figure 30:
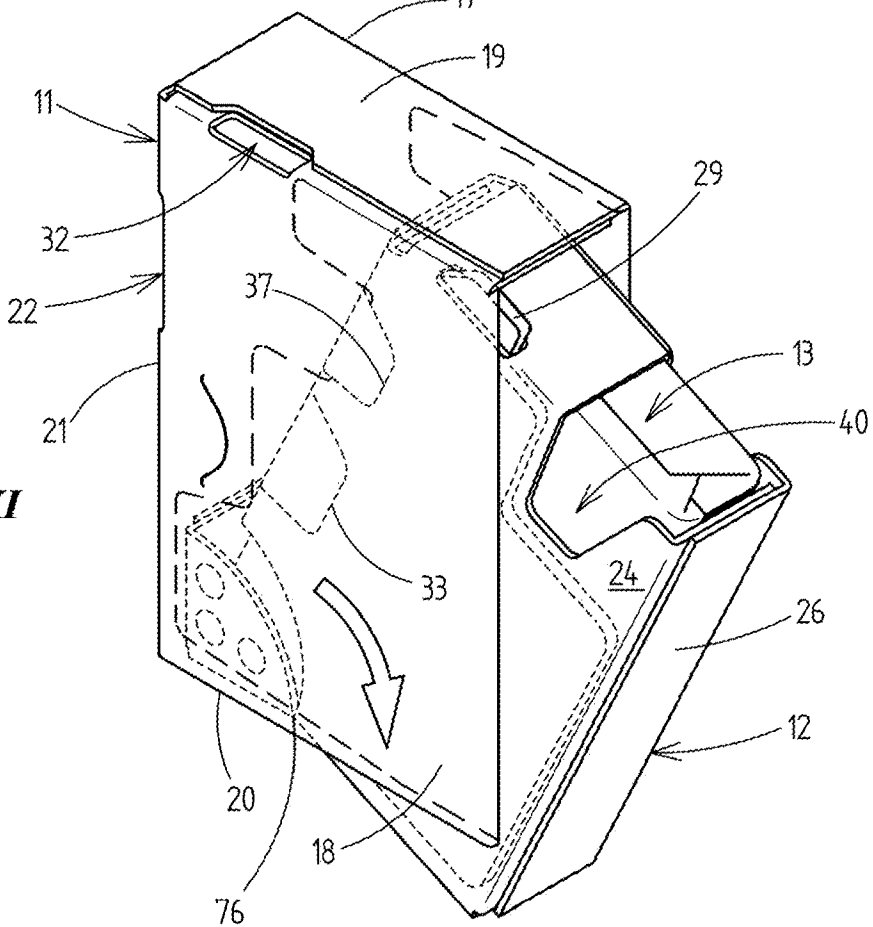
FIG. 30 shows the package according to FIG. 29 in an opened position, in a view onto the rear side.
Figure 29:
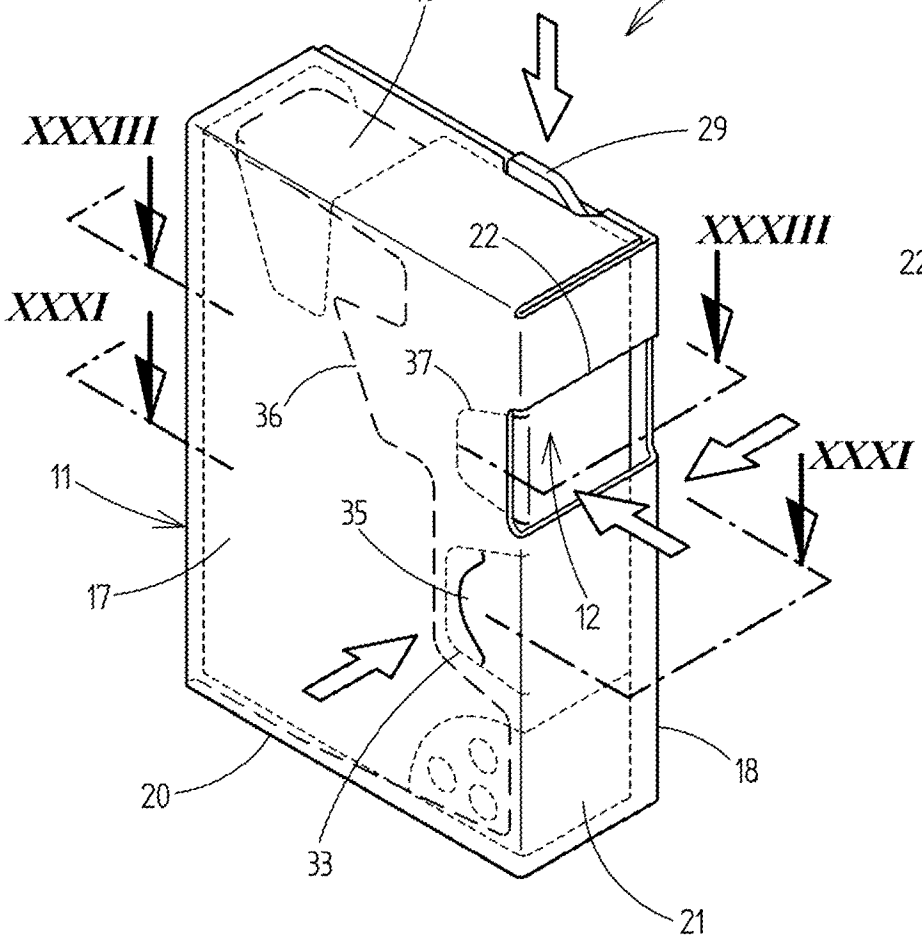
FIG. 29 shows a fifth exemplary embodiment of a package in an isometric illustration, in a view onto the front side.

The pivoting mechanism of the package 10 that is integrated in the inner package 12 and enables the inner package 12 to be pivoted out of the outer package 11 represents a peculiarity. The inner package 12, with the aid of (three) glue spots 31, is in each case permanently connected to the inside tabs 34 in the region of the front wall 17, or the rear wall 18, respectively, of the outer package 11 in a corner region 73, 74 of the front wall 23 and of the rear wall 24. To this end, the inside tabs 34 are at least partially extended in length into the region of the corner regions 73, 74. Furthermore, the corner regions 73, 74 are in each case delimited from the remainder of the respective wall by a perforation line 75. The perforation lines 75 extend onward across the lateral tabs 42, 43 to the periphery of the blank 14. A linear joint 76 in the region of the base wall 25 runs between the perforation lines 75 on both sides. When the inner package 12 is pivoted out of the outer package 11, the two perforation lines 75 are severed so that the large part of the inner package 12 can be pivoted about the linear joint 86 (FIG. 30). It is conceivable for the outer package 12 to have a partial base wall 20 which, for example proceeding from the narrow-side wall 21, extends across the corner region 73, 74, or to the linear joint 76, respectively.

Figure 35:
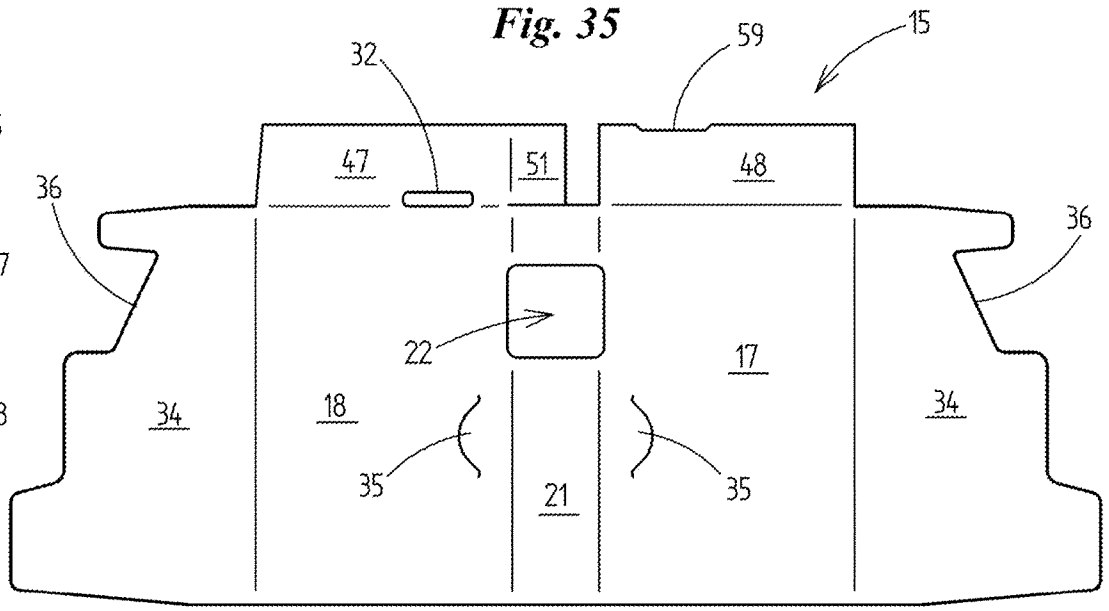
FIG. 35 shows a non-folded blank for the outer package of the package according to FIG. 29.

It can be seen in FIG. 35 that the end wall 19 of the outer package 11 is formed by an inner top tab 47 and an outer top tab 48 which are disposed so as to mutually overlap. Here too, a corner flap 51 is disposed between the respective tabs, said corner flap 51 being folded into the narrow-side wall 21.

Miscellaneous

Figure 31:
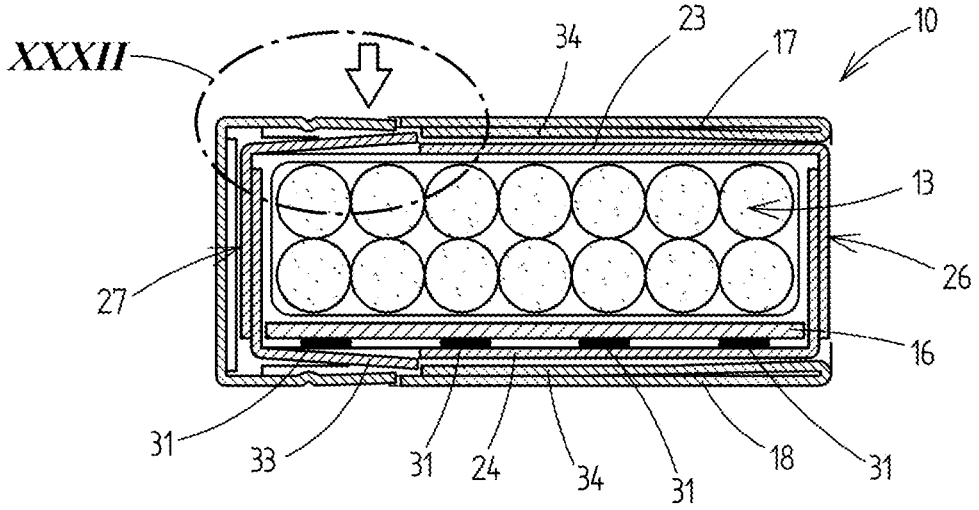
FIG. 31 shows a horizontal section through the package along the section line XXXI-XXXI in FIG. 29.
Figure 39:
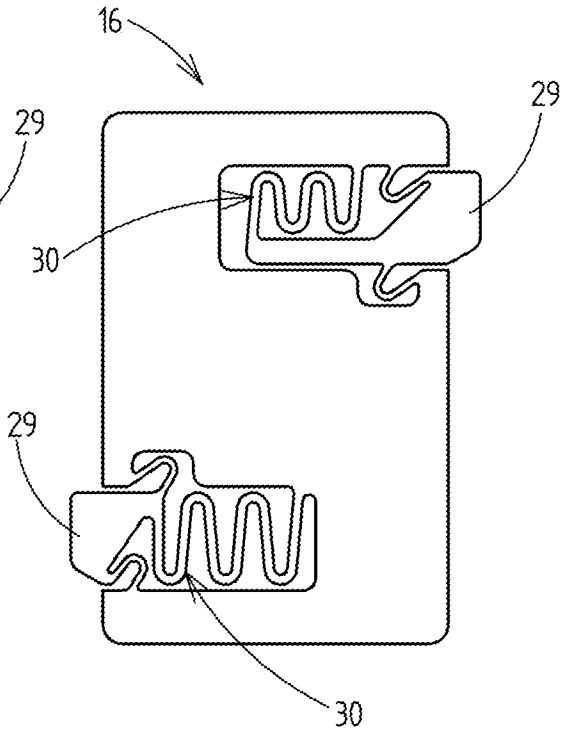
FIG. 39 shows a third variant of a security card.
Figure 38:
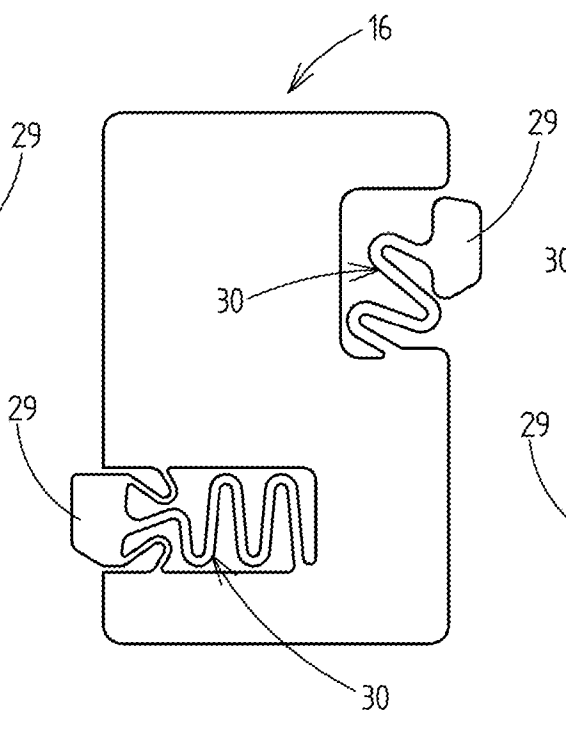
FIG. 38 shows a further variant of a security card.
Figure 37:
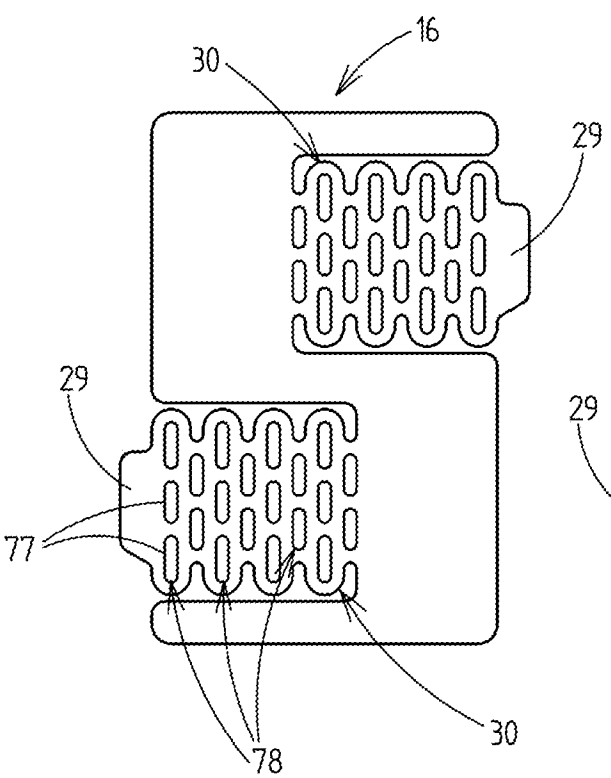
FIG. 37 shows a variant of a security card.

FIGS. 37 to 39 show variants of the security card 16, in particular for the first three exemplary embodiments. It is provided in FIGS. 38 and 39 that the security card 16 is formed from an elastic plastics material. The spring elements 30 here, in the solution according to FIG. 30, are configured as compression springs, and in the solution according to FIG. 31, are configured as tension springs. FIG. 37 shows a security card from a long-fiber cardboard material in which the spring elements 30 are configured as flexible springs. In the solution according to FIGS. 38 and 39 the spring elements 30 may also be configured as flexible springs.

A further peculiarity can lie in that at least one spring element 30 (preferably all spring elements 30) is/are formed by punched cuts 77 in the material of the security card 16, in particular by punched cuts 77 in the shape of elongate holes, wherein a plurality of punched cuts 77 are disposed in one row 78, and a plurality of rows 78 having punched cuts 77 are disposed so as to be mutually parallel, and wherein punched cuts 77 of adjacent rows 78 are disposed so as to be mutually offset.

Moreover, that side of the security card 16 that is externally visible can be covered with a label which obscures the spring elements 30, or the externally visible side of the security card 16, respectively. The label in the region of the spring elements 30 here should be embodied so as to be free of any adhesive in order to maintain the function of the spring. Moreover, the adhesive-free region of the label in the region of the spring elements 30 can serve as a guide wall, or delimitation wall, respectively, so as to prevent the spring elements 30 laterally kinking outward from the flat plane. In this case, the spring elements 30 are thus delimited or enclosed, respectively, from both sides by the walls of the label and the rear wall 24 of the inner package 12.

A coupon 72 which may be printed with information and/or details of the content is also disposed in the package 10 in many exemplary embodiments.

LIST OF REFERENCE SIGNS

10 Package
11 Outer package
12 Inner package
13 Package content
14 Blank (inner package)
15 Blank (outer package)
16 Security card
17 Front wall (outer package)
18 Rear wall (outer package)
19 End wall (outer package)
20 Base wall (outer package)
21 Narrow-side wall (outer package)
22 Opening (outer package)
23 Front wall (inner package)
24 Rear wall (inner package)
25 Base wall (inner package)
26 Narrow-side wall (inner package)
27 Narrow-side wall (inner package)
28 End wall (inner package)
29 Tab (latching tab)
30 Spring element
31 Glue spot
32 Clearance (outer package)
33 Detent tab (inner package)
34 Inside tab (outer package)
35 Unlatching tab (outer package)
36 Latching tab (outer package)
37 Latching tab (inner package)
38 Clearance
39 Clearance
40 Retrieval opening
41 Folding flap (inner package)
42 Lateral tab (inner package)
43 Lateral tab (inner package)
44 Corner flap (inner package)
45 Top tab (inner package)
46 Connecting tab (inner package)
47 Top tab (outer package)
48 Top tab (outer package)
49 Base tab (outer package)
50 Base tab (outer package)
51 Corner flap (outer package)
52 Pivoting lid (inner package)
53 Linear joint (inner package)
54 Articulated tab (inner package)
55 Connecting tab (inner package)
56 Overlapping tab (inner package)
57 Lateral tab (outer package)
58 Lateral tab (inner package)
59 Punched cut (outer package)
60 Box part (outer package)
61 Pivoting lid (outer package)

62 Linear joint (outer package)
63 Box part (inner package)
64 Pivoting lid (inner package)
65 Front wall (pivoting lid)
66 Closing edge (pivoting lid)
67 Clearance (inner package)
68 Slot (inner package)
69 Clearance (inner package)
70 Lid inside flap (outer package)
71 Incision (inner package)
72 Coupon
73 Corner region (front wall)
74 Corner region (rear wall)
75 Perforation line
76 Linear joint
77 Punched cut
78 Row

The invention claimed is:

1. A tamper-evident package (10) having an outer package (11) and having an inner package (12), wherein the inner package (12) is at least partially received in the outer package (11), and wherein the inner package (12) for opening and closing the package (10) is disposed so as to be displaceable in the outer package (11), and wherein the package (10) has an anti-tamper feature having at least one securing means for impeding or preventing opening of the package (10), or the access to products disposed in the inner package (12), wherein the securing means is or are effective between the inner package (12) and the outer package (11) so as to impede or prevent the inner package (12) being displaced in the outer package (11) in order for the package (10) to be opened, wherein the inner package (12) and the outer package (11) each are assigned corresponding one of the securing means in the event of a closed package (10) being mutually engaged and specified to be able to be disengaged in order for the package (10) to be opened, wherein the securing means is or are assigned to a security card (16) and is or are configured as tabs (29) which latch into corresponding clearances (32) in the outer package (11) and which, in the event of a closed package (10), the tabs (29) are able to be disengaged from the clearances (32) in order to open the package (10) by application of pressure to the tabs (29).

2. The package as claimed in claim 1, wherein the package (10) has a plurality of the securing means, and in that the package (10) is structured such that at least the plurality, of the securing means have to be disengaged in order to be able to open the package (10).

3. The package as claimed in claim 2, wherein the plurality of the securing means are disposed on opposite sides of the package (10).

4. The package as claimed in claim 2, wherein the plurality of the securing means are disposed in mutually offset planes which run so as to be perpendicular or parallel to a longitudinal central axis of the package (10).

5. The package as claimed in claim 1, wherein the securing means assigned to the inner package (12) are assigned to a security card (16) which is fastened to a lateral wall of the inner package (12) by being adhesively bonded to the external side of the lateral wall of the inner package (12).

6. The package as claimed in claim 5, wherein the security card (16) is configured as a planar member which extends across a major part of the lateral wall of the inner package (12), the securing means being disposed on a periphery of said planar member.

7. The package as claimed in claim 1, wherein the outer package (11) has a cuboid shape with six sides, and in that the outer package (11) has a front wall (17) as well as a corresponding opposite rear wall (18), and in that the outer package (11) has side walls (21) which in each case connect the front wall (17) and the rear wall (18) to one another, and in that the outer package (11) is configured as a sleeve and is open in a region of a base side of the outer package (11) and of an end side of the outer package (11) opposite the base side.

8. The package as claimed in claim 1, wherein the inner package (12) has a pivoting lid (64), and in that the package (10) is structured such that the pivoting lid (64) of the inner package (12), when in a closed position, at least partially bears on a wall of the outer package (11) so that the pivoting lid (64) of the inner package (12) cannot be opened when the inner package (12) has not been at least partially extracted from the outer package (11).

9. The package as claimed in claim 1, wherein the inner package (12) on a rear wall (24) possesses incisions (71) which extend across substantially an entire width of the rear wall (24) and transversely to a longitudinal direction of the package (10), said incisions being disposed at a mutual spacing.

10. A tamper-evident package (10) having an outer package (11) and having an inner package (12), wherein the inner package (12) is at least partially received in the outer package (11), and wherein the inner package (12) for opening and closing the package (10) is disposed so as to be displaceable in the outer package (11), wherein the package (10) has an anti-tamper feature having at least one securing means for impeding or preventing opening of the package (10), or access to products disposed in the inner package (12), wherein the securing means is or are effective between the inner package (12) and the outer package (11) so as to impede or prevent the inner package (12) being displaced in the outer package (11) in order for the package (10) to be opened, wherein the securing means is or are assigned to a security card (16) and is or are configured as tabs (29) which latch into corresponding clearances (32) in the outer package (11), wherein the security card (16) is able to be deformed by pressure on the tabs (29) in such a way that the tabs (29) are able to be disengaged from the clearances (32).

11. The package as claimed in claim 9, wherein the security card (16) between two of the incisions (71) is connected to a region of the rear wall (24) of the inner package (12) by adhesive bonding, and in that the region of the rear wall (24), conjointly with the security card (16), is able to be deformed by pressure on the tabs (29).

12. A tamper-evident package (10) having an outer package (11) and having an inner package (12), wherein the inner package (12) is at least partially received in the outer package (11), and wherein the inner package (12) for opening and closing the package (10) is disposed so as to be displaceable in the outer package (11), wherein the package (10) has an anti-tamper feature having at least one securing means for impeding or preventing opening of the package (10), or access to products disposed in the inner package (12), wherein the securing means is or are effective between the inner package (12) and the outer package (11) so as to impede or prevent the inner package (12) being displaced in the outer package (11) in order for the package (10) to be opened, wherein the securing means is or are assigned to a security card (16) and is or are configured as tabs (29) which latch into corresponding clearances (32) in the outer package (11), wherein the tabs (29) of the security card (16) and the associated clearances (32) are in each case disposed in a region of the side walls (21), and in that the tabs (29) are disposed in a transition region between the side walls (21) and the rear wall (18) of the outer package (11), and in that one of the tabs (29) is disposed closer to the base side and another one of the tabs (29) is disposed closer to the end side of the outer package (11).

13. The package as claimed in claim 1, wherein the inner package (12) has a pivoting lid (64) and wherein a lower closing edge (66) of the pivoting lid (64) of the inner package (12) is contoured in an arcuate manner so as to facilitate the introduction of the inner package (12) into the outer package (11).

14. The package as claimed in claim 1, wherein the inner package (12) has a pivoting lid (64), the inner package (12) further comprising narrow-side walls (26, 27) that are at least partially configured in two tiers, specifically by an overlap of in each case one outer lateral tab and one inner lateral tab, and in that a front wall of the pivoting lid (64) of the inner package (12) and a front wall of the inner package (12) lie flush against one another when the inner package (12) is in a closed position.

15. A tamper-evident package (10) having an outer package (11) and having an inner package (12), wherein the inner package (12) is at least partially received in the outer package (11), and wherein the inner package (12) for opening and closing the package (10) is disposed so as to be displaceable in the outer package (11), and wherein the package (10) has an anti-tamper feature having at least one securing means for impeding or preventing opening of the package (10), or access to products disposed in the inner package (12), wherein the securing means is or are effective between the inner package (12) and the outer package (11) so as to impede or prevent the inner package (12) being displaced in the outer package (11) in order for the package (10) to be opened, wherein the securing means is or are assigned to a security card (16) and is or are configured as tabs (29), wherein the package (10) is structured such that two of the tabs (29) of the security card (16) have to be depressed in order for the package (10) to be opened, and the inner package (12) has to be at least partially extracted from the outer package (11) in order to open the pivoting lid (64) of the inner package (11).

16. The package as claimed in claim 1, wherein the security card (16) is composed of a long-fiber cardboard material, or of plastics material.

* * * * *